US011395573B2

(12) United States Patent
Yamazaki

(10) Patent No.: US 11,395,573 B2
(45) **Date of Patent: *Jul. 26, 2022**

(54) WATER-DISINTEGRABLE SHEET AND METHOD FOR PRODUCING WATER-DISINTEGRABLE SHEET

(71) Applicant: DAIO PAPER CORPORATION, Shikokuchuo (JP)

(72) Inventor: Kosuke Yamazaki, Shikokuchuo (JP)

(73) Assignee: DAIO PAPER CORPORATION, Shikokuchuo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/326,797

(22) PCT Filed: May 23, 2017

(86) PCT No.: PCT/JP2017/019157

§ 371 (c)(1),
(2) Date: Feb. 20, 2019

(87) PCT Pub. No.: WO2018/037646

PCT Pub. Date: Mar. 1, 2018

(65) Prior Publication Data

US 2019/0223680 A1 Jul. 25, 2019

(30) Foreign Application Priority Data

Aug. 26, 2016 (JP) ..... JP2016-165530

(51) Int. Cl.

| | |
|---|---|
| ***A47L 13/17*** | (2006.01) |
| ***D21H 11/18*** | (2006.01) |
| ***D21H 19/10*** | (2006.01) |

(52) U.S. Cl.
CPC ..... *A47L 13/17* (2013.01); *D21H 11/18* (2013.01); *D21H 19/10* (2013.01)

(58) Field of Classification Search
CPC ..... D21H 11/18; D21H 17/63; D21H 27/002; D21H 19/10; D21H 27/00; D21H 21/18;
(Continued)

(56) References Cited

U.S. PATENT DOCUMENTS 3,563,241 A * 2/1971 Evans ..... A61L 15/28 604/364
3,868,205 A 2/1975 Thomas
(Continued)

FOREIGN PATENT DOCUMENTS

CN 1390997 A 1/2003
CN 104271023 A 1/2015
(Continued)

OTHER PUBLICATIONS

Machine Translation of JP 11-206611-A (Year: 1999).*
(Continued)

*Primary Examiner* — Jose A Fortuna
(74) *Attorney, Agent, or Firm* — Maier & Maier, PLLC

(57) ABSTRACT

A water-disintegrable sheet in which a base paper sheet is impregnated with an aqueous agent is provided. The base paper sheet has a weight per unit area of 30 to 150 gsm, and includes a water-soluble binder and cellulose nanofibers. The aqueous agent includes a cross-linking agent which cross-links with a water-soluble binder.

21 Claims, 9 Drawing Sheets

(58) Field of Classification Search
CPC ..... D21H 27/30; D21H 17/06; D21H 17/43; D21H 19/00; A47L 13/17; A47K 10/16; A47K 2010/3266; B32B 2260/028
See application file for complete search history.

(56) References Cited

U.S. PATENT DOCUMENTS

| | | | | |
|---|---|---|---|---|
| 5,264,269 | A | 11/1993 | Kakiuchi et al. | |
| 5,281,306 | A * | 1/1994 | Kakiuchi | C11D 17/041 162/158 |
| 6,106,928 | A | 8/2000 | Laurent et al. | |
| 6,132,557 | A | 10/2000 | Takeuchi et al. | |
| 6,455,129 | B1 | 9/2002 | Kershaw et al. | |
| 6,749,718 | B2 * | 6/2004 | Takai | D21H 25/005 162/109 |
| 6,827,819 | B2 | 12/2004 | Dwiggins et al. | |
| 9,949,609 | B2 * | 4/2018 | Baer | A61K 8/0208 |
| 10,422,084 | B2 * | 9/2019 | Mukoyama | D21H 21/20 |
| 10,925,443 | B2 * | 2/2021 | Izumi | A47L 13/16 |
| 11,155,966 | B2 * | 10/2021 | Yamazaki | D21H 27/002 |
| 11,272,824 | B2 * | 3/2022 | Mukoyama | D21H 21/18 |
| 2003/0000665 | A1 * | 1/2003 | Takai | D21H 25/005 162/115 |
| 2006/0037724 | A1 | 2/2006 | Akai et al. | |
| 2007/0110963 | A1 | 5/2007 | Uehara et al. | |
| 2007/0128411 | A1 | 6/2007 | Kawai et al. | |
| 2008/0263797 | A1 | 10/2008 | Berger et al. | |
| 2009/0126885 | A1 | 5/2009 | Akai et al. | |
| 2010/0233481 | A1 * | 9/2010 | Isogai | D21H 11/20 428/401 |
| 2012/0219766 | A1 * | 8/2012 | Gupta | D21H 15/02 428/195.1 |
| 2012/0246854 | A1 | 10/2012 | Uchiyama et al. | |
| 2012/0277351 | A1 * | 11/2012 | Yano | D21D 1/34 524/35 |
| 2013/0017349 | A1 * | 1/2013 | Heiskanen | C09D 101/02 428/36.1 |
| 2013/0209772 | A1 * | 8/2013 | Sandstrom | D21H 11/18 428/220 |
| 2014/0182797 | A1 * | 7/2014 | Paltakari | D21H 17/24 162/72 |
| 2014/0189970 | A1 * | 7/2014 | Fingal | D21H 27/002 15/104.93 |
| 2014/0259484 | A1 * | 9/2014 | Baer | A47L 13/17 15/104.93 |
| 2015/0090414 | A1 | 4/2015 | Yamada | |
| 2015/0167243 | A1 * | 6/2015 | Bilodeau | D21H 17/005 162/65 |
| 2015/0267070 | A1 * | 9/2015 | Tsuji | C08L 1/02 106/163.01 |
| 2015/0315747 | A1 * | 11/2015 | Heiskanen | A47L 13/16 162/181.2 |
| 2016/0016717 | A1 * | 1/2016 | Toubeau | D21H 21/10 220/62.13 |
| 2016/0024718 | A1 * | 1/2016 | Lee | D21C 9/007 162/9 |
| 2016/0053437 | A1 * | 2/2016 | Husband | D21H 5/1236 162/9 |
| 2016/0168696 | A1 * | 6/2016 | Missoum | D21H 25/04 427/299 |
| 2016/0355983 | A1 * | 12/2016 | Yamada | D21H 17/70 |
| 2017/0073893 | A1 * | 3/2017 | Bilodeau | D21D 1/306 |
| 2017/0160206 | A1 * | 6/2017 | Nuopponen | C08L 1/00 |
| 2017/0306562 | A1 * | 10/2017 | Phipps | D04H 3/08 |
| 2017/0314200 | A1 * | 11/2017 | Johansson | C08J 9/28 |
| 2018/0098672 | A1 * | 4/2018 | Izumi | B32B 29/005 |
| 2018/0146834 | A1 * | 5/2018 | Izumi | D21H 27/30 |
| 2019/0003128 | A1 | 1/2019 | Mukoyama et al. | |
| 2019/0223680 | A1 * | 7/2019 | Yamazaki | D21H 17/63 |
| 2019/0246863 | A1 * | 8/2019 | Mukoyama | D21H 17/63 |
| 2019/0276958 | A1 * | 9/2019 | Konishi | D21H 13/08 |
| 2022/0095877 | A1 * | 3/2022 | Yamasaki | D21H 17/15 |

FOREIGN PATENT DOCUMENTS

| | | | | |
|---|---|---|---|---|
| EP | 0421163 | A2 | 4/1991 | |
| EP | 0900878 | A2 | 3/1999 | |
| EP | 1630288 | A1 | 3/2006 | |
| EP | 3505038 | A1 * | 7/2019 | D21H 19/34 |
| EP | 3521511 | A1 * | 8/2019 | D21H 11/18 |
| EP | 3533370 | A1 * | 9/2019 | D04H 1/4374 |
| EP | 3521511 | B1 * | 12/2021 | A47K 10/16 |
| EP | 3915455 | A1 * | 12/2021 | A47L 13/17 |
| JP | 61113896 | A | 5/1986 | |
| JP | S62126197 | U | 8/1987 | |
| JP | 02149237 | A | 6/1990 | |
| JP | 11206611 | A * | 8/1999 | |
| JP | 3865506 | B2 | 1/2007 | |
| JP | 2007209657 | A | 8/2007 | |
| JP | 2008094067 | A | 4/2008 | |
| JP | 2009203412 | A | 9/2009 | |
| JP | 2011030793 | A | 2/2011 | |
| JP | 5959695 | B1 | 8/2016 | |
| JP | 6211160 | B1 | 10/2017 | |
| JP | 6470236 | B2 * | 2/2019 | D21H 27/002 |
| JP | 6474923 | B2 * | 2/2019 | |
| JP | 2021188170 | A * | 12/2021 | |
| WO | WO-2018037646 | A1 * | 3/2018 | A47L 13/17 |
| WO | WO-2018061306 | A * | 4/2018 | D21H 11/18 |
| WO | WO-2021241205 | A1 * | 12/2021 | |

OTHER PUBLICATIONS

International Preliminary Report on Patentability (IPRP) (and English language translation thereof) and Written Opinion dated Feb. 26, 2019 issued in International Application No. PCT/JP2017/019157.

Extended European Search Report (EESR) dated Jan. 23, 2020 issued in European Application No. 17843134.2.

International Search Report (ISR) dated Jul. 4, 2017 issued in International Application No. PCT/JP2017/019157.

Japanese Office Action dated Aug. 22, 2017 issued in counterpart Japanese Patent Application No. 2016-165530.

Japanese Office Action dated Jul. 4, 2017 issued in counterpart Japanese Patent Application No. 2016-165530.

Written Opinion dated Jul. 4, 2017 issued in International Application No. PCT/JP2017/019157.

Office Action (Non-Final Rejection) dated May 12, 2020 issued in related U.S. Appl. No. 16/338,416.

Related U.S. Appl. No. 16/338,416; First Named Inventor: Shinpei Mukoyama; Title: "Water-Disintegrable Shfft and Method for Manufacturing Water-Disintegrable Sheet"; Filed: Mar. 29, 2019.

Chinese Office Action (and English language translation thereof) dated Jul. 29, 2020 issued in Chinese Application No. 201780052138.8.

Chinese Office Action dated Jul. 5, 2021, in connection with corresponding CN Application No. 201780052138.8 (16 pp , including manual English translation).

Chinese Office Action (and English language translation thereof) dated Feb. 5, 2021 issued in Chinese Application No. 201780052138.8.

Chinese Office Action (and English language translation thereof) dated Mar. 11, 2021 issued in Chinese Application No. 201780060194.6.

* cited by examiner

WATER-DISINTEGRABLE SHEET AND METHOD FOR PRODUCING WATER-DISINTEGRABLE SHEET

TECHNICAL FIELD

The present invention relates to a water-disintegrable sheet impregnated with an aqueous agent in advance, such as a toilet cleaning sheet, and a method for producing the water-disintegrable sheet.

BACKGROUND ART

For cleaning toilets, there has been used a dust cloth made of woven fabric that can be repeatedly used. Instead, in recent years, a disposable water-disintegrable sheet made of paper is used. This kind of water-disintegrable sheet is provided with a detergent impregnated, and can be processed by being flushed down the toilet after use.

Such a water-disintegrable sheet is required to have paper strength so as not to be torn in a wet state impregnated with a detergent during a wiping operation, and water-disintegrability so as not to clog piping when flushed down the toilet or the like. As a technique for effectively achieving these features, it is known to use a water-disintegrable sheet to which a water soluble binder containing carboxymethyl cellulose (hereinafter referred to as CMC) is added as a base paper (refer to, for example, Japanese Patent No. 3865506).

SUMMARY OF INVENTION

Technical Problem

However, for example, when a water-disintegrable sheet is used for cleaning the toilet, the conventional water-disintegrable sheet is sometimes torn if used for rubbing the rim (edge) of the toilet bowl or the like strongly. Therefore, it has been a problem to improve tear resistance against strong rubbing, while ensuring water-disintegrability.

The present invention has been made in view of the above problem, and an object of the present invention to provide a water-disintegrable sheet having improved rear resistance against strong rubbing while ensuring water-disintegrability, and a method for producing the water-disintegrable sheet.

Solution to Problem

One aspect of the present invention is a water-disintegrable sheet in which a base paper sheet is impregnated with an aqueous agent. The base paper sheet has a weight per unit area of 30 to 150 gsm and includes a water-soluble binder and cellulose nanofibers, and the aqueous agent includes a cross-linking agent which cross-links with a water-soluble binder.

In addition, the water-soluble binder can have a carboxyl group, and the cross-linking agent can be a metal ion.

Moreover, the content of the water-soluble binder can gradually increase from an inner side toward a front surface and toward aback surface in a thickness direction of the base paper sheet.

Another aspect of the present invention is a method for producing water-disintegrable sheet in which a base paper sheet is impregnated with an aqueous agent including a cross-linking agent which cross-links with a water-soluble binder, and which has a weight per unit area of 30 to 150 gsm. The method includes applying a binder solution including a water-soluble binder to an outer surface of a base paper sheet, wherein cellulose nanofibers are added to the binder solution applied to the outer surface of the base paper sheet.

In addition, the binder solution can be applied to an outer surface of the base paper sheet so that addition amount of the cellulose nanofibers is 0.1% by weight or more and 2.0% by weight or less with respect to the base paper sheet.

Advantageous Effects of Invention

According to the present invention, because the base paper sheet contains a water-soluble binder and cellulose nanofibers, the surface strength of the base paper sheet can be improved. Further, by impregnating the base paper sheet with an aqueous agent containing a cross-linking agent which cross-links with the water-soluble binder, the added cellulose nanofibers can improve the wet tensile strength. This makes it possible to improve the tear resistance against strong rubbing, while ensuring the water-disintegrability, therefore, the wiping property can be improved.

In general, if fine cellulose nanofibers are blended in a base paper sheet, it is considered that the dry strength would increase due to increase in the hydrogen bonding point between the fibers of the base paper sheet and the cellulose nanofibers, however, the wet strength would not be improved because the hydrogen bond is broken by contact with water. The present invention has been made based on a new finding that the wet tensile strength can be improved when the water-soluble binder and cellulose nanofibers are blended into abase paper sheet and the sheet is impregnated with the aqueous agent containing the cross-linking agent which cross-links with the water-soluble binder, as compared with the case where a water-soluble binder is blended into a base paper sheet and the sheet is impregnated with the aqueous agent containing the cross-linking agent which cross-links with the water-soluble binder.

DESCRIPTION OF EMBODIMENTS

Figure 1:
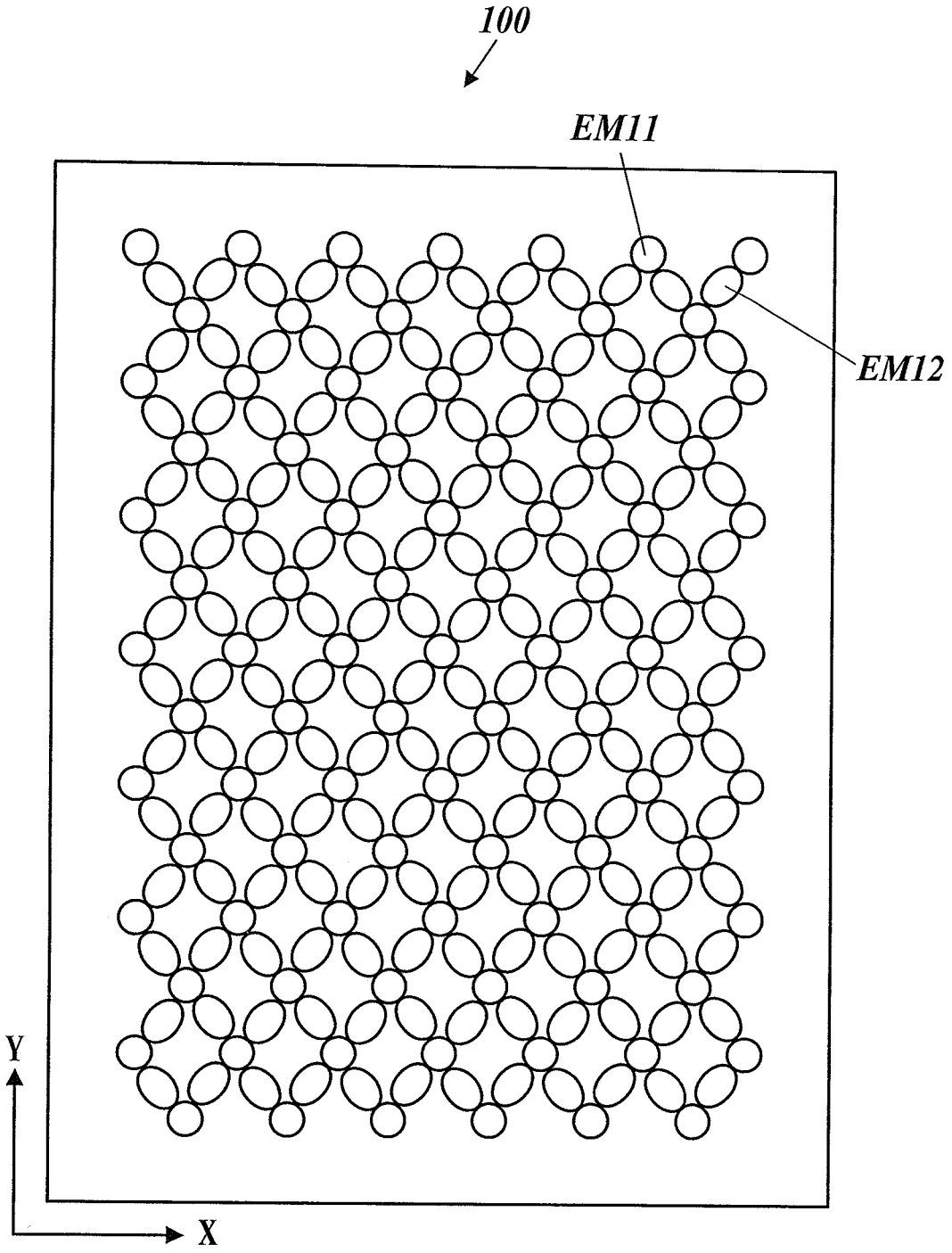
FIG. 1 is a plan view showing an example of a toilet cleaning sheet according to the present embodiment.

Hereinafter, embodiments of the water-disintegrable sheet of the present invention are described in detail with reference to the drawings. However, the scope of the present invention is not limited to the illustrated examples.

The water-disintegrable sheet, will be described using a toilet cleaning sheet as an example, but the water-disintegrable sheet also includes a wet tissue etc. impregnated with the aqueous agent for wiping other than a toilet cleaning sheet. The conveyance direction of the paper at the time of producing the toilet cleaning sheet is referred to as the Y direction (length direction), and the direction orthogonal to the conveyance direction will be described as the X direction (width direction).

[Description of Toilet Cleaning Sheet]

The toilet cleaning sheet 100 is formed by applying ply process (laminating) of multiple (for example, two) base paper sheets and is impregnated with a predetermined aqueous agent.

The base paper sheet may be formed of one base paper sheet to which a ply process has not been applied.

The weight per unit area of the base paper sheet is about 30 to 150 gsm. The weight per unit area is based on JIS P 8124.

The base paper sheet of the toilet cleaning sheet 100 is configured with a water-disintegrable fiber aggregate so that it can be discarded in the toilet water pool as it is after cleaning the toilet.

The fiber aggregate is not particularly limited as long as it has water-disintegrability, but a single layer or multiple layers of paper or nonwoven fabric can be suitably used. The fiber raw material may be a natural fiber or a synthetic fiber, and they may be mixed. Suitable fiber raw materials include cellulosic fibers such as wood pulp, non-wood pulp, rayon, and cotton, biodegradable fibers made of polylactic acid, and the like. In addition, with these fibers as a main component, polyethylene fibers, polypropylene fibers, polyvinyl alcohol fibers, polyester fibers, polyacrylonitrile fibers, synthetic pulp, glass wool, and the like may be used in combination.

In particular, a fiber aggregate containing at least pulp is preferable, and suitable pulp to be used as a raw material is leaf bleached kraft pulp (LBKP) and needle bleached kraft pulp (NBKP) blended at an appropriate ratio.

More preferably, a blending ratio of the leaf bleached kraft pulp exceeds 50% by weight, in other words, the blending ratio of the needle bleached kraft pulp to the leaf bleached kraft pulp is less than 1/1. By increasing the blending ratio of the leaf bleached kraft pulp to the needle bleached kraft pulp, gaps between fibers is reduced and moisture transpiration is suppressed. Therefore, it is possible to improve difficulty of drying.

Further, it may be configured of a sheet made of crushed pulp or a sheet of crushed pulp covered or sandwiched with water-disintegrable paper.

A water-soluble binder for enhancing paper strength is added to the base paper sheet of the toilet cleaning sheet 100. Examples of the water-soluble binder include a binder component such as carboxymethylcellulose, polyvinyl alcohol, starch or a derivative thereof, hydroxypropyl cellulose, sodium alginate, trant gum, guar gum, xanthan gum, gum arabic, carrageenan, galactomannan, gelatin, casein, albumin, purplan, polyethylene oxide, Viscose, polyvinyl ethyl ether, sodium polyacrylate, sodium polymethacrylate, polyacrylamide, hydroxylated derivatives of polyacrylic acid, polyvinyl pyrrolidone/vinyl pyrrolidone vinyl acetate copolymer, and the like.

In particular, from the viewpoint of good water-disintegrability and the possibility of developing wet strength by cross-linking reaction, a water-soluble binder having a carboxyl group is preferably used.

The water-soluble binder having a carboxyl group is an anionic water-soluble binder which readily generates carboxylate in water. Examples thereof include polysaccharide derivatives, synthetic polymers, and natural products. Examples of the polysaccharide derivative include a salt of carboxymethyl cellulose, carboxyethyl cellulose or a salt thereof, and carboxymethylated starch or a salt thereof, and an alkali metal salt of carboxymethyl cellulose (CMC) is particularly preferable.

It is desirable that CMC has an etherification degree of 0.6 to 2.0, particularly 0.9 to 1.8, more preferably 1.0 to 1.5. The water-disintegrability and the development of wet paper strength are extremely good.

It is preferable to use water-swellable CMC. This exerts a function of linking the fibers constituting the sheet while remaining unswollen by forming cross-links with a specific metal ion as the cross-linking agent in the aqueous agent, so that strength as a durable wiping sheet in cleaning/wiping is exhibited.

In the case of the toilet cleaning sheet 100 of the present embodiment, CMC is added as the water-soluble binder.

Examples of the synthetic polymers include a salt of a polymer or a copolymer of an unsaturated carboxylic acid, a salt of a copolymer of an unsaturated carboxylic acid and a monomer copolymerizable with the unsaturated carboxylic acid, and the like. Examples of the unsaturated carboxylic acid include acrylic acid, methacrylic acid, itaconic acid, crotonic acid, maleic anhydride, maleic acid, fumaric acid, and the like. Examples of the monomer copolymerizable with them include esters of these unsaturated carboxylic acids, vinyl acetate, ethylene, acrylamide, vinyl ether, and the like. A particularly preferred synthetic polymer is one using acrylic acid or methacrylic acid as the unsaturated carboxylic acid, and specifically include salts of polyacrylic acid, polymethacrylic acid, or acrylic acid methacrylic acid copolymer, and salts of a copolymer of acrylic acid or methacrylic acid, an alkyl acrylate or alkyl methacrylate. Examples of natural products include sodium alginate, xanthan gum, gellan gum, tarraganth gum, pectin, and the like.

The toilet cleaning sheet 100 may be in a state in which the base paper sheet is uniformly impregnated CMC with in the thickness direction, but preferably in a state in which the content of CMC in the raw paper sheet gradually increases from the center in the thickness direction toward the front face and the back face. As a result, the toilet cleaning sheet 100 is less likely to be torn even if it is used for rubbing the rim of a toilet bowl strongly, as compared with a conventional product which is uniformly impregnated with the water-soluble binder of the same amount.

In addition, cellulose nanofibers (hereinafter referred to as CNF) are added to the toilet cleaning sheet 100. The addition amount of CNF is not particularly limited, but is preferably 0.1% by weight or more and 2.0% by weight or less with respect to the base paper sheet before CNF and CMC are added. From the viewpoint of economic efficiency, the addition amount of CNF is preferably 2.0% by weight or less. That is, even if the addition amount of CNF is increased beyond 2.0% by weight, the efficiency does not change so much.

CNF refers to fine cellulose fibers obtained by fibrillating pulp fibers. In general, CNF refers to cellulose fibers containing cellulose fine fibers having a fiber width of nano-order size (1 nm or more and 1000 nm or less). An average fiber width is preferably 100 nm or less. Number average, median, mode diameter (mode) and the like are calculated from a certain number of fibers as the average fiber width.

Examples of pulp fibers usable for the production of CNF include chemical pulp such as broad leaf tree pulp (LBKP) and needle leaf tree pulp (NBKP); mechanical pulp such as Bleaching thermomechanical pulp (BTMP), stone ground pulp (SGP), pressurized stone ground pulp (PGW), refiner ground pulp (RGP), chemi-ground pulp (CGP), thermogrand pulp (TGP), grand pulp (GP), thermomechanical pulp (TMP), chemi-Thermo Mechanical pulp (CTMP), and refiner mechanical pulp (RMP); used paper pulp manufactured from tea waste paper, craft envelope waste paper, magazine waste paper, newspaper waste paper, leaflets waste paper, office waste paper, cardboard waste paper, high quality white waste paper, Kent waste paper, simili waste paper, regional waste paper, and groundwood paper; and deinked pulp (DIP) made by deinking used paper pulp. As long as the effects of the present invention are not impaired, these may be used alone or in combination of multiple kinds. Further, chemical treatment such as carboxymethylation may be applied to the pulp fibers before use.

Methods for producing CNF are not limited to, but include mechanical methods such as a high pressure homogenizer method, a microfluidizer method, a grinder grinding method, a bead mill freeze pulverization method, and an ultrasonic fibrillating method. In addition, nanofiber formation is promoted by using TEMPO oxidation treatment, phosphoric acid esterification treatment, acid treatment, etc. in combination.

The fiber orientation ratio (length/width) in the length and width directions of the toilet cleaning sheet 100 is not particularly limited, but it is preferably 0.8 to 2.0, more preferably 0.8 to 1.2.

Figure 2A:
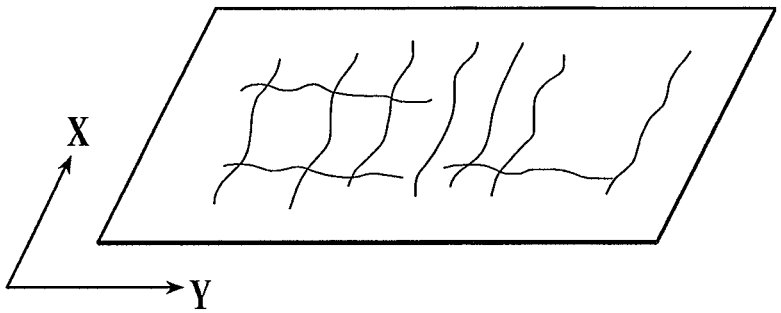
FIG. 2A is a view showing fiber orientation of conventional paper.
Figure 2B:
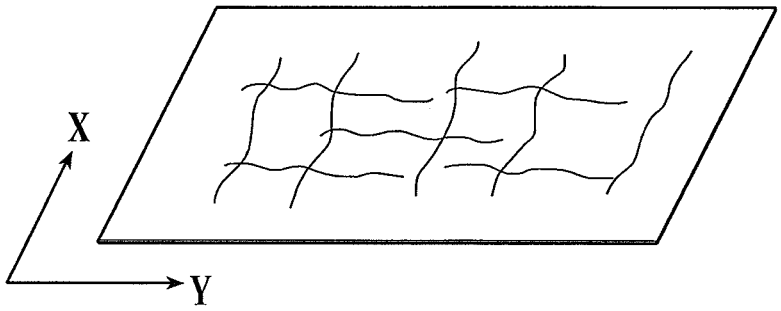
FIG. 2B is a view showing fiber orientation of the present invention.

In the papermaking step which is a step for producing paper, since fibers are spread over wire(s) of a papermaking machine and flows in the transport direction, many fibers are generally aligned in the length direction which is the conveyance direction of the papermaking machine (for example, length:width=2.3:1, refer to FIG. 2A) on the paper. Therefore, the fiber density in the width direction is low so that the fiber tends to break. That is, it tends to be torn depending on the wiping direction. Therefore, in the present embodiment, as shown in FIG. 2B, the fiber orientation ratio in the length and width directions of the toilet cleaning sheet 100 is set to 0.8 to 2.0, preferably 0.8 to 1.2. As a result, it is possible to provide the toilet cleaning sheet 100 which is hard to be torn even by wiping with it in any direction. The fiber orientation ratio in the length and width directions can be obtained from the ratio of the wet strengths in the MD to CD directions.

The toilet cleaning sheet 100 of the present embodiment is impregnated with a predetermined aqueous agent containing the cross-linking agent for cross-linking of the water-soluble binder, specifically, a predetermined aqueous agent containing, in addition to the cross-linking agent, an aqueous detergent, a fragrance, an antiseptic, a disinfectant, an organic solvent and the like, including an auxiliary agent. The impregnated aqueous agent is 100 to 500% by weight, preferably 150 to 300% by weight, relative to the weight of the base paper sheet as the base material of the toilet cleaning sheet 100.

As the cross-linking agent, boric acid, various metal ions and the like can be used, but when CMC is used as the water-soluble binder, a polyvalent metal ion is preferably used. In particular, it is preferable to use one or more of polyvalent metal ions selected from the group consisting of alkaline earth metals, manganese, zinc, cobalt, and nickel, from the viewpoint of developing wet strength for durability in use by sufficiently bonding the fibers and from the viewpoint of improving sufficient water-disintegrability. Among these metal ions, ions of calcium, strontium, barium, zinc, cobalt, or nickel are used particularly preferably.

As the aqueous detergent, for example, lower or higher (aliphatic) alcohol can be used in addition to a surfactant.

As the fragrance, for example, one or several kinds of oily fragrance such as orange oil, in addition to an aqueous fragrance, can be appropriately selected and used.

As the antiseptic, for example, parabens such as methylparaben, ethylparaben, propylparaben, and the like may be used. As the disinfecting agent, for example, benzalkonium chloride, chlorhexidine gluconate, povidone iodine, ethanol, benzyl cetyl oxide, triclosan, chloroxylenol, isopropylmethylphenol, and the like may be used. As the organic solvent, polyhydric alcohols such as glycol (divalent), glycerin (trivalent), sorbitol (tetravalent), and the like may be used.

Further, the auxiliary agent of the above-mentioned components of the aqueous agent may be selected appropriately, and a component which fulfills other functions may be contained in the aqueous agent as necessary.

According to the present invention, the wet tensile strength can be improved when the water-soluble binder and cellulose nanofibers are blended into the base paper sheet and the sheet is impregnated with the aqueous agent containing the cross-linking agent which cross-links with the water-soluble binder, as compared with the case where the water-soluble binder is blended into the base paper sheet and the sheet is impregnated with the aqueous agent containing the cross-linking agent which cross-links with the water-soluble binder.

Although the surface of the toilet cleaning sheet 100 may be the paper sheet as it is, embossing is preferably applied. In the case of the toilet cleaning sheet 100, for example, as shown in FIG. 1, two kinds of embosses EM11 and EM12 are embossed on it.

Although the shape, number, area ratio, etc. of the embosses are arbitrary, in the case of the toilet cleaning sheet 100, the embosses EM11 are arranged to form a diamond lattice. As a result, uneven wiping can be reduced as compared with the case where the embosses EM11 are arranged to form a square lattice or a rectangular lattice. The embosses EM12 are arranged between the embosses EM11.

Figure 3A:
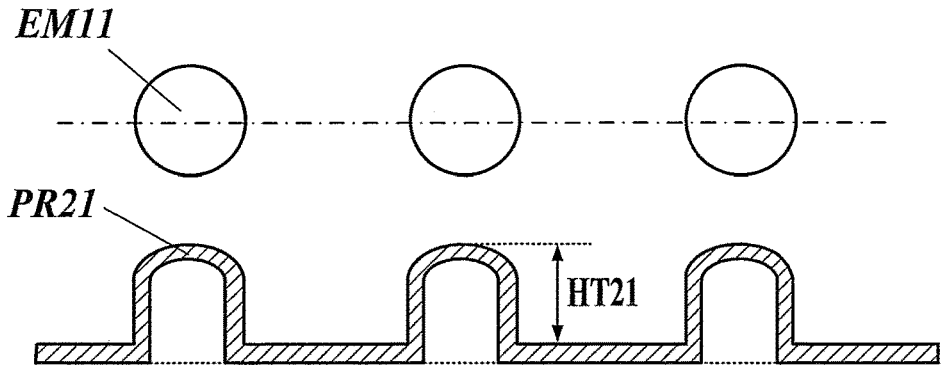
FIG. 3A is an enlarged view and a sectional view of emboss portions of the toilet cleaning sheet.

The embosses EM11 each have, as shown in FIG. 3A, a protrusion PR21 having a curved shape.

Figure 3B:
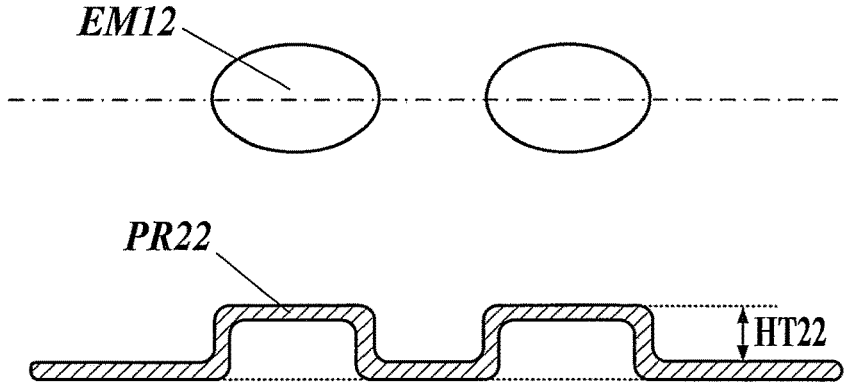
FIG. 3B is an enlarged view and a sectional view of emboss portions of the toilet cleaning sheet.

The embosses EM12 each have, as shown in FIG. 3B, a protrusion PR22 having a plane shape.

Figure 3C:
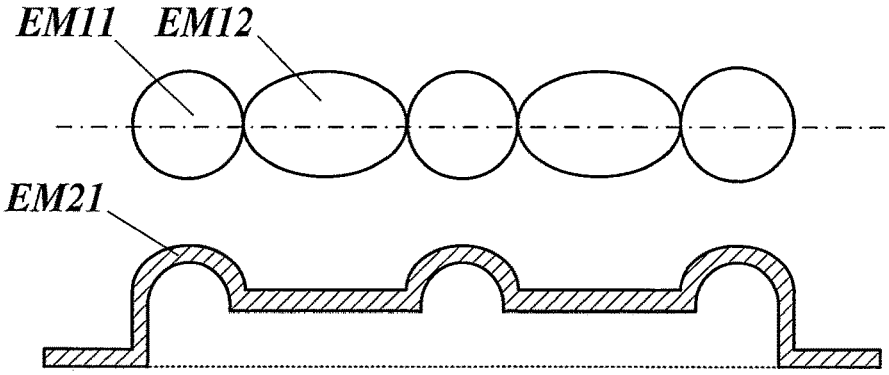
FIG. 3C is an enlarged view and a sectional view of emboss portions of the toilet cleaning sheet.

Since the embosses EM12 are arranged between the embosses EM11, the protrusions PR21 of the embosses EM11 and the protrusions PR22 of the embosses EM12 are closely adhered to each other to form a continuous emboss EM21 as shown in FIG. 3C.

Alternatively, the protrusions PR21 of the embosses EM11 and the protrusions PR22 of the embosses EM12 may be only close to each other and do not have to be continuous.

By forming the two kinds of embosses EM11 and EM12 in this way, it is possible to increase contact areas with the object to be cleaned. As a result, the toilet cleaning sheet 100 becomes less stiff and has higher wiping property.

That is, by forming the embosses EM11 whose protrusions PR21 have a curved surface and the embosses EM12 whose protrusions PR22 have a plane surface on the entire sheet surface of the toilet cleaning sheet 100, the respective embosses are deformed and the contact areas increase for the first time when a force is applied to the toilet cleaning sheet 100 during the wiping operation. Therefore, as well as increasing the contact areas, flexibility is also improved due to deformation of the respective embosses.

Figure 4A:
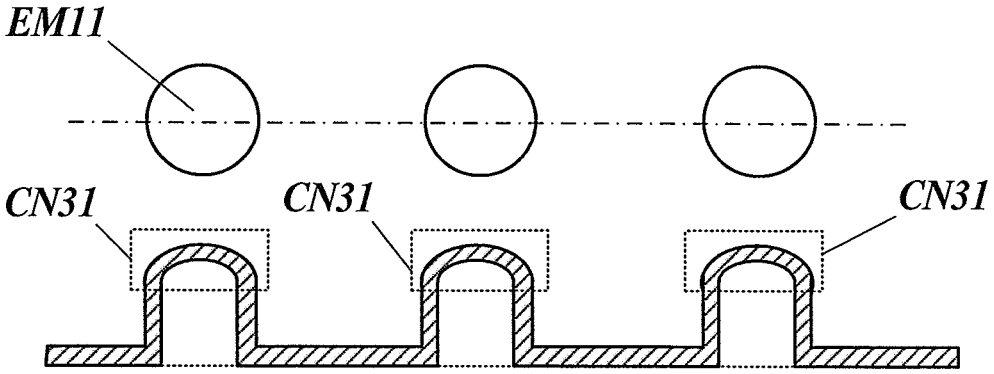
FIG. 4A is an explanatory view showing an example of a contact area of the embosses.
Figure 4B:
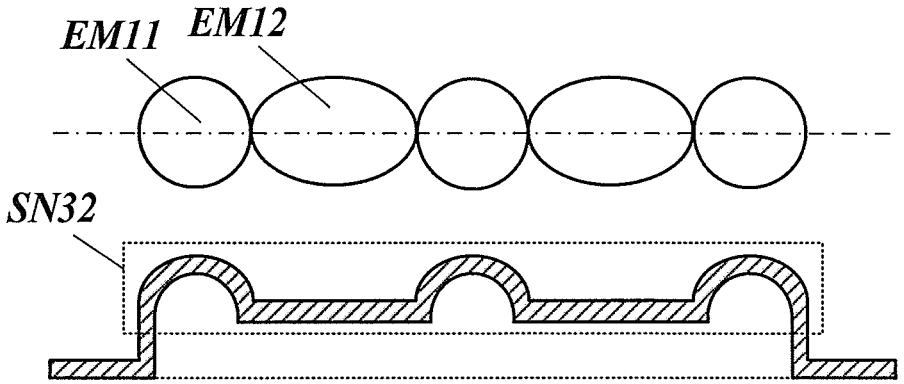
FIG. 4B is an explanatory view showing an example of a contact area of the embosses.

For example, as shown in FIG. 4A, if there is a single kind of embosses EM11, the contact areas CN31 after deformation of the embosses EM11 due to the force applied to the toilet cleaning sheet 100 during the wiping operation are generated discretely in the vicinity of the respective embosses EM11. On the other hand, if there are two kinds of embosses EM11 and EM12 in combination, as shown in FIG. 4B, the contact areas SN32 after deformation of the embosses EM11 and EM12 due to the force applied to the toilet cleaning sheet 100 during the wiping operation are increased as compared with the contact area CN31 of FIG. 4A.

Further, the two kinds of embosses EM11 and EM12 also exhibit the effect of normal embosses, and it is possible to improve the texture, absorbency, bulkiness, etc. of the toilet cleaning sheet. Furthermore, as well as ordinary embosses, the continuous embosses EM21 also exhibit the effect of good appearance by embossing.

The toilet cleaning sheet 100 is folded in two at the center portion in the Y direction by a fold process. Then, it is stored in a plastic case for storage or in a packaging film in a folded state, and unfolded as necessary at the time of use. The way of folding the toilet cleaning sheet 100 is not limited to folding in two, but may be folding in four or eight, for example.

[Method for Producing Toilet Cleaning Sheet]

Figure 5:
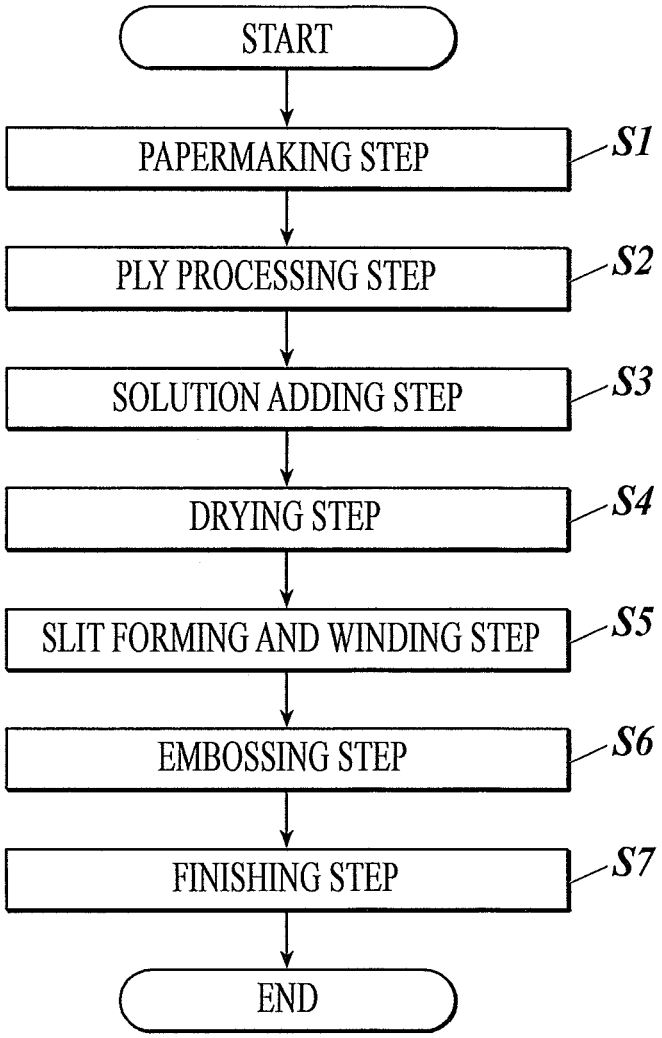
FIG. 5 is a flowchart showing a method for producing the toilet cleaning sheet according to the present embodiment.
Figure 6:
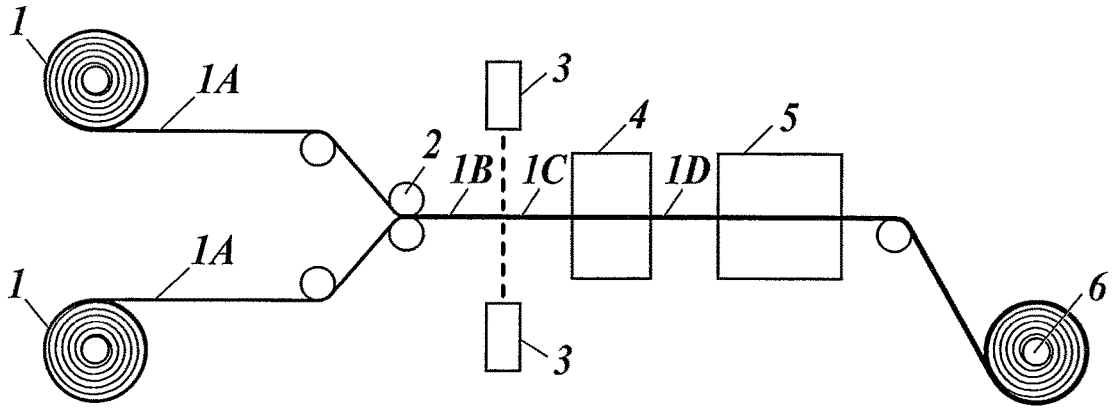
FIG. 6 is a schematic view of equipment (solution addition equipment) for producing the toilet cleaning sheet according to the present embodiment.
Figure 7:
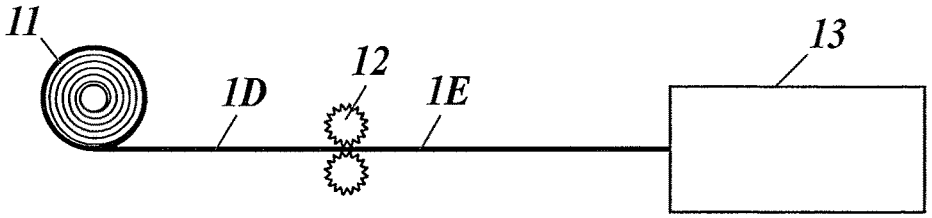
FIG. 7 is a schematic view of equipment (processing equipment) for producing the toilet cleaning sheet according to the present embodiment.

Next, a method for producing the toilet cleaning sheet will be described. FIG. 5 is a flowchart showing a method for producing the toilet cleaning sheet. FIG. 6 is a schematic diagram of solution adding equipment for adding a binder solution to the base paper sheet (paper sheet) of the toilet cleaning sheet. FIG. 7 is a schematic view of processing equipment for processing the base paper sheet to which the binder solution has been added in the solution adding equipment shown in FIG. 6.

In the method for producing the toilet cleaning sheet, as shown in FIG. 5, first, a papermaking step (S1) of making a paper to be a base paper (not shown) is performed with a papermaking machine.

Next, as shown in FIGS. 5 and 6, in the solution addition equipment, the ply processing step (S2) of making a ply continuous sheet 1B by the ply process of the continuous dry base paper 1A, 1A which are respectively drawn out from multiple (for example, two) primary web roll 1, 1 on which the base paper is wound up after papermaking; a solution adding step (S3) of adding the binder solution to the ply continuous sheet 1B to form a continuous sheet 1C; a drying step (S4) of drying the continuous sheet 1C; and a slit forming and winding step (S5) of forming a slit and winding the dried continuous water-disintegrable sheet 1D are performed. Although the number of primary web rolls can be appropriately changed as long as it is two or more, in the following descriptions, an example of using two primary web rolls will be described.

Next, as shown in FIGS. 5 and 7, in the processing equipment, an embossing step (S6) of embossing the continuous water-disintegrable sheet 1D drawn out from the secondary web roll 11 after winding in the slit forming and winding step (S5), and a finishing step (S7) of applying finish process to the embossed sheet 1E on which embossing has been performed. Details of each step will be described later.

[Papermaking Step]

First, the papermaking step (S1) according to the present embodiment will be described. In the papermaking step (S1) of the present invention, for example, the base paper sheet is formed by making a papermaking raw material by a known wet papermaking technique. That is, after making the papermaking raw material in a state of wet paper, it is dried with a dryer or the like to form the base paper sheet such as thin paper or crepe paper.

Besides pulp and a coagulant, papermaking chemicals such as wet paper strength agent, adhesive, release agent and the like may be appropriately used in the base paper sheet.

In addition, although the binder solution is added in a solution addition step in the solution addition equipment described later in the embodiment of the present invention, the binder solution may be added in the papermaking step.

If the binder solution is also added in the papermaking step, it is possible to obtain a water-disintegrable sheet having large total strength. Then, by further adding the binder solution in the subsequent step of the solution adding step, the surface strength of the water-disintegrable sheet can be further increased.

As a method of adding the binder solution in a papermaking step, for example, a method of wet papermaking using a raw material in which the water-soluble binder and a fixing agent to fix the water-soluble binder to the pulp fibers are added to a dispersion containing pulp as a papermaking raw material (Japanese Unexamined Patent Publication No. hei3-193996). That is, the water-soluble binder is internally adding in the method. It is also possible to perform wet papermaking of a sheet from a dispersion containing pulp, to spray and dry or to coat and dry the water-soluble binder after press dewatering or semi-drying, and to produce a fiber sheet containing a predetermined amount of the water-soluble binder. That is, the water-soluble binder is externally added in the method. In this case, it is possible to obtain a fiber sheet with a lower density and better water-disintegrability by using a pre-drying system such as a hot air passage dryer rather than press dewatering. Furthermore, instead of the wet papermaking method described above, it is also possible to produce a fiber sheet by fibrillating the dry pulp fibers without using water, forming a web, spraying the water-soluble binder, and then drying process. It is a so-called air laid production method.

Figure 8:
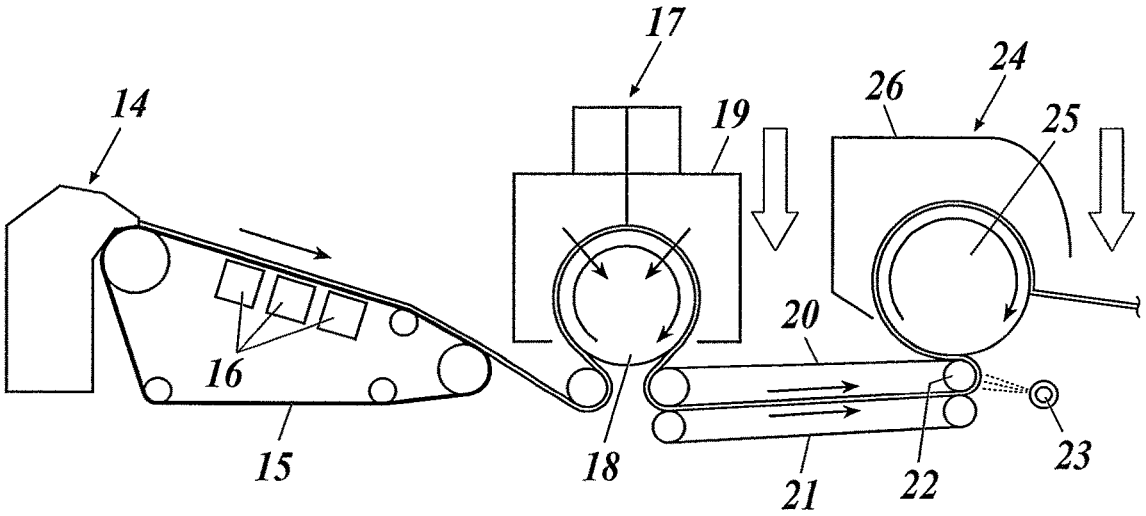
FIG. 8 is a schematic view showing an example of a papermaking machine.

FIG. 8 shows a schematic diagram of an example of a producing apparatus preferably used for producing a fiber sheet where the water-soluble binder is used as a binder. The producing apparatus (wet papermaking machine) shown in FIG. 8 is provided with a former 14, a wire part, a first dry part 17, a spray part, and a second dry part 24.

The former 14 adjusts the finished paper material supplied from a preparation device (not shown) to a predetermined concentration and then supplies it to the wire part. The preparation device (not shown) is provided with a device for separating and pulverizing raw materials such as pulp fibers and an adding device for adding additives such as a sizing agent, a pigment, a paper strengthening agent, a bleaching agent, a coagulant and the like to the separated and pulverized raw material, and is configured to prepare the paper material including a raw material at a predetermined concentration according to the features of water-disintegrable paper as a finished paper material. It is also possible to mix a binder in pulp slurry. In the wire part, wet paper is formed from the finished paper material supplied from the former in a paper making net. In the first dry part 17, the wet paper formed in the wire part is dried. In the spray part, the binder is sprayed onto the paper dried in the first dry part 17. In the second dry part 24, the paper in wet condition with the binder sprayed at the spray part is dried.

The finished paper material supplied from the former 14 is subjected to papermaking at the wire part, and wet paper is formed on the wire 15. Moisture in the wet paper is removed by suction by a suction box 16 installed at the wire part, so that the wet paper has a predetermined moisture content. The wet paper is then introduced into the first dry part 17 and dried. The first dry part 17 is configured with a through air dryer (hereinafter referred to as TAD). The TAD includes a rotating drum 18 whose circumferential surface is air permeable, and a hood 19 which covers the rotating drum 18 substantially airtightly. In the TAD, air heated to a predetermined temperature is supplied into the hood 19. The heated air flows from the outside to the inside of the rotating drum 18. The wet paper is conveyed while being held on the circumferential surface of the rotating drum 18 rotating in the arrow direction in FIG. 8. While being conveyed through the TAD, the heated air penetrates the wet paper in the thickness direction thereof, whereby the wet paper is dried and becomes paper.

At the spray part, an aqueous solution including a binder (binder solution) is sprayed on the paper obtained at the first dry part 17. The spray part is at a position between the first and second dry parts 17, 24. Both dry parts 17, 24 are connected via a conveyor.

The conveyor is provided with an upper conveyor belt 20 and a lower conveyor belt 21 each rotating in the arrow direction. The conveyor 20 is configured to convey the paper dried by the TAD of the first dry part 17 to the second dry part 24 in a state of being sandwiched between these belts 20, 21. A vacuum roll 22 is arranged at a folding back end on the downstream side of the upper conveyor belt 20. The vacuum roll 22 attracts paper on the back surface of the upper conveyor belt 20, and conveys the upper conveyor belt 20 under the attracting state.

As shown in FIG. 8, the spray part is provided with a spray nozzle 23. The spray nozzle 23 is arranged below the second dry part 24, facing the vacuum roll 22. The spray nozzle 23 sprays a spray liquid including the binder toward the vacuum roll 22 and adds (externally adds) the spraying liquid to the paper.

After the binder is supplied at the spray part, the paper is conveyed to the second dryer part 24. The second dryer part 24 is configured with a Yankee dryer. The paper in a wet state by spraying the spraying liquid is conveyed while being held on the circumferential surface of the rotating drum 25 of the Yankee dryer installed in the hood 26. The paper becomes dry while it is held and conveyed by the rotating drum 25.

The binder is supplied at the spray part at a position between the first and second dry parts 17 and 24. For example, the binder may be sprayed from above the upper conveyor belt 20 (the position indicated by the arrow between the first and second dry parts 17 and 24 shown in FIG. 8). Further, the binder may be sprayed from the upper side of the paper dried at the second dry part 24 (the position indicated by the arrow on the right side of the second dry part 24 shown in FIG. 8). Between the first and second dry parts 17, 24 and after the second dry part 24, the binder may be sprayed not only from the upper side but also from the lower side or from both the upper and lower sides.

In the present embodiment, in the papermaking step, the fiber orientation ratio in the length and width directions (length/width) of the base paper sheet is adjusted to 0.8 to 2.0, preferably 0.8 to 1.2. The fiber orientation can be adjusted in the papermaking machine, for example, by adjusting the angle at which the papermaking raw material is supplied to the wire part. The angle at which the papermaking raw material is supplied may be adjusted, for example, by adjusting the slice opening degree of the head box. Alternatively, the fiber orientation may be adjusted by giving vibration in a direction orthogonal to the conveyance direction (running direction) of the papermaking machine.

[Ply Processing Step]

Next, the ply processing step (S2) of the present embodiment will be described. In the ply processing step (S2), as shown in FIG. 6, the continuous dry base paper 1A, 1A each continuously drawn out from the web roll 1 is supplied to an overlapping unit 2 for the ply process along the continuous direction to form a ply continuous sheet 1B. The overlapping unit 2 is configured with a pair of rolls, performs the ply process of each continuous base paper 1A, 1A to form a ply continuous sheet 1B to which the ply process has been applied. When overlapping the continuous dry base paper 1A, 1A, it may be weakly fastened with pin embosses (contact embosses) so that the continuous dry base paper 1A, 1A is not easily displaced.

[Solution Adding Step]

Next, the solution adding step (S3) of the present embodiment will be described. In the solution adding step (S3), as shown in FIG. 6, the binder solution is sprayed on both outer surfaces (the surface of the continuous dry base paper 1A, 1A which does not face the continuous dry base paper 1A, 1A after the ply process) of the ply continuous sheet (paper sheet) 1B by each of the two-fluid type spray nozzles 3, 3 to produce a continuous sheet 1C.

The binder solution contains carboxyl methyl cellulose (CMC) as the water soluble binder. The concentration of carboxyl methyl cellulose in the binder solution is 0.6 to 10% by weight, preferably 0.7% by weight or more and less than 4% by weight. Further, the binder solution contains cellulose nanofibers (CNF).

As a method of spraying the binder solution, the binder solution described above may be sprayed onto one of the outer surface of the ply continuous sheet 1B. A sheet equivalent to the continuous sheet 1C described above may be generated by spraying the above binder solution from a two-fluid type spray nozzle on the outer surface (the surface of the sheet which does not face another sheet) of at least one of the continuous dry base paper 1A, 1A respectively drawn out from the above-described primary web rolls 1, 1, and immediately after that, by applying the ply process to the continuous dry base paper 1A, 1A.

The two-fluid type spray nozzle 3 is a spray nozzle for mixing and spraying compressed air and liquid divided into two systems. As compared with the one-fluid type spray nozzle from which sprays the compressed liquid alone, it is possible to spray the liquid finely and uniformly.

In the present embodiment, the nozzle diameter of the spray nozzle 3 is set to 0.09 gal/min or less. In addition, preferred spraying conditions of the present embodiment include the concentration of the binder solution of less than 4%, the viscosity of the binder solution of 400 to 1300 Mpa·s, the discharge temperature of 50 to 70° C., the liquid pressure of 2 MPa or more, and the air pressure of 0.05 to 0.2 MPs. It is also preferred to spray the binder solution so that the added amount of the binder (CMC) is 0.7% by weight or more, with respect to the base paper (ply continuous sheet 1B). It is also preferred to spray the binder solution so that the addition amount of CNF is 0.1% by weight or more and 2.0% by weight or less with respect to the weight of the base paper (ply continuous sheet 1B).

By spraying the binder solution onto the outer surface of the ply continuous sheet 1B in this way, the content of the water-soluble binder in the toilet cleaning sheet gradually increases from the center in the thickness direction (in the case of application to both surfaces) or from a surface to which the binder solution is not applied (in the case of application to one surface) toward the surface to which the binder solution is applied. Therefore, it is possible to improve the surface strength while securing water-disintegrability, and to produce a toilet cleaning sheet with less damages even against strong rubbing.

[Drying Step]

Next, the drying step (S4) of the present embodiment will be described. In the drying step (S4), as shown in FIG. 6, the insoluble liquid in the binder solution of the continuous sheet 10 evaporates in the drying equipment 4, so that the effective ingredient, in particular CMC, is fixed to the fibers.

Here, since the amount of impregnated binder solution decreases from the outer surface of the continuous sheet 10 toward the inner side in the thickness direction, the CMC fixing amount decreases toward the inner side in the thickness direction. Therefore, in impregnation with the aqueous agent in the finishing step (S7) described later, the cross-linking reaction does not likely to occur and the number of gaps increases at the inner side in the thickness direction. As a result, the aqueous agent can be confined in the sheet. Therefore, the obtained toilet cleaning sheet is difficult to dry. In addition, since a lot of cross-linking reaction of CMC occur near the outer surface of the continuous sheet 1C, the surface strength of the obtained toilet cleaning sheet enhanced.

As the drying equipment 4, dryer equipment with a hood for blowing hot air against the continuous sheet 1C and drying it can be used. In order to adhere the sheets more tightly to each other, a press roll or a turn roll may be installed and the continuous sheet 1C may be passed through the press roll or the turn roll before the drying step (S4).

The drying equipment may be infra-red irradiation equipment. In this case, multiple infrared ray irradiation units are arranged in parallel in the conveyance direction of the continuous sheet 1C, and the continuous sheet 1C to be conveyed is irradiated with infrared rays and becomes dry. Since moisture is heated by the infrared rays and dried, it is can be uniformly dried compared with a dryer with hot air, and the occurrence of wrinkles in the slit forming and winding step is prevented in the subsequent stage.

[Slit Forming and Winding Step]

Next, the slit forming and winding step (S5) of the present embodiment will be described. In the slit forming and winding step (S5), in order to prepare a web to be processed with an off-line processing machine from a continuous water-disintegrable sheet 1D to which the ply process has been applied, the continuous water-disintegrable sheet 1D dried in the drying step (S4) and to which CMC has been fixed is subjected to slit formation at a predetermined width with a slitter 5 while adjusting the tension, and is wound in winder equipment 6. The winding speed is determined as appropriate considering the ply processing step (S2), solution adding step (S3) and drying step (S4). It should be noted that the sheet breaks if the winding speed is too rapid, and wrinkles will occur if it is too slow.

By crimping the continuous water-disintegrable sheet 1D to which the ply process has been applied in the slit forming and winding step (S5), the continuous water-disintegrable sheet 1D is further integrated so as to be substantially one sheet.

[Embossing Step]

Next, the embossing step (S6) of the present embodiment will be described. In the embossing step (S6), as shown in FIG. 7, the continuous water-disintegrable sheet 1D drawn out from the secondary web roll 11 is subjected to embossing for forming a predetermined shape on the entire surface of the sheet by the embossing roll 12. The object of this embossing is to enhance the strength, bulkiness, wiping property, etc. of the sheet and to improve the design.

[Finishing Step]

Next, the finishing step (S7) of the present embodiment will be described. In the finishing step (S7), as shown in FIG. 7, the following steps are performed as a series of events in the finishing processing equipment 13: cutting of the embossed sheet 1E; folding of the respective cut sheets, impregnation with the aqueous agent (including aqueous a detergent, a fragrance, an antiseptic, a disinfectant, a paper strengthening agent, organic solvent, etc.) to the respective folded sheets, and packaging of the respective sheets impregnated with the aqueous agent.

Through these steps, the toilet cleaning sheet is produced.

EXAMPLES

Next, Examples and Comparative Examples of the present invention will be described with reference to TABLEs 1 to 5 regarding the result of wet tensile strength test, evaluation result of water disintegrability, the result of surface strength, and the evaluation result of actual use. CNF used here was CNF with 100% NBKP. CNF having an average fiber width (median diameter) of 49 nm was used. CNF was obtained by refiner treatment of NBKP for rough fibrillation, and treating it four times with a high pressure homogenizer to for fibrillation. CNF is added to the binder solution as a 3.0% dispersion liquid.

Here, a method of measuring the fiber width (average fiber width) of CNF will be described.

First, 100 ml of an aqueous dispersion of cellulose nanofibers having a solid content concentration of 0.01 to 0.1 mass % is filtered with a Teflon (registered trademark) membrane filter, and the solvent is displaced once by 100 ml of ethanol and three times 20 ml by t-butanol.

Next, by freeze-drying and osmium-coating, a sample is obtained. This sample is observed in a SEM image by an electron microscope at a magnification of 5,000 times, 10,000 times, or 30,000 times (in the present embodiment, a magnification of 30,000 times) according to the width of the fibers constituting the sample. Specifically, two diagonal lines are drawn on the observed image, and arbitrarily three straight lines passing through the intersection of the diagonal lines are drawn. Further, the fiber width is visually measured from a total of 100 fibers which intersect with these three straight lines. Then, the median diameter of the measured values is taken as the average fiber diameter. The average fiber diameter is not limited to the median diameter of the measured value, but may be, for example, the number average diameter or the mode diameter (most frequent diameter).

The conditions of respective Examples and Comparative Examples are described below. The sample corresponding to each example was prepared so as to meet the following conditions: after making the base paper having weighing (in a dry state) of 5 gsm to be two-ply in the water-soluble binder application equipment and further applying an aqueous solution mixed with CMC and CNF (application amount of CMC: 0.6 g/m$^2$, 1.2 g/m$^2$) with spray to the outer surface of each sheet, it was dried until the moisture percentage reached about 8% by passing through a hot air dryer (temperature 180° C.), and while forming slits at a predetermined width, a base sheet for processing the base paper sheet was prepared. The sampled base paper sheet was uniformly impregnated with a chemical solution of 200% by weight of the weight of the sheet with a syringe and used as a sample.

Example 1

Blend of pulp; NBKP:LBKP=40:60

Weighing (in a dry state); 90 g/m2 (2-ply)

Item Number of CMC; CMC 1330 Daicel Corporation

Application amount of CMC; 0.6 dry·g/m$^2$

CNF blending ratio; 0.1% by weight

Aqueous agent component; Cross-linking agent (zinc) 3.56% by weight, Propylene glycol monomethyl ether (PGME) 14.5% by weight, Propylene glycol (PG) 3.0% by weight Impregnated amount of Aqueous agent; 200% by weight of base paper weight Example 2

CNF blending ratio; 0.5% by weight

The other conditions are the same as in Example 1.

Example 3

CNF blending ratio; 1.0% by weight

The other conditions are the same as in Example 1.

Example 4

CNF blending ratio; 2.0% by weight

The other conditions are the same as in Example 1.

Example 5

Application amount of CMC; 1.2 dry·g/m$^2$

The other conditions are the same as in Example 1.

Example 6

Application amount of CMC; 1.2 dry·g/m$^2$

CNF blending ratio; 0.5% by weight

The other conditions are the same as in Example 1.

Example 7

Application amount of CMC; 1.2 dry·g/m$^2$

CNF blending ratio; 1.0% by weight

The other conditions are the same as in Example 1.

Example 8

Application amount of CMC; 1.2 dry·g/m$^2$

CNF blending ratio; 2.0% by weight

The other conditions are the same as in Example 1.

Comparative Example 1

CNF blending ratio; 0.0% by weight

The other conditions are the same as in Example 1.

Comparative Example 2 application amount of CMC; 1.2 dry·g/m$^2$

CNF blending ratio; 0.0% by weight

The other conditions are the same as in Example 1.

Comparative Example 3

CNF blending ratio; 0.0% by weight

Aqueous agent component; None (water only)

The other conditions are the same as in Example 1.

Comparative Example 4

Aqueous agent component; None (water only)

The other conditions are the same as in Example 1.

Comparative Example 5

CNF blending ratio; 0.5% by weight

Aqueous agent component; None (water only)

The other conditions are the same as in Example 1.

Comparative Example 6

CNF blending ratio; 1.0% by weight

Aqueous agent component; None (water only)

The other conditions are the same as in Example 1.

Comparative Example 7

CNF blending ratio; 2.0% by weight

Aqueous agent component; None (water only)

The other conditions are the same as in Example 1.

Comparative Example 8

Application amount of CMC; 1.2 dry·g/m$^2$

CNF blending ratio; 0.0% by weight

Aqueous agent component; None (water only)

The other conditions are the same as in Example 1.

Comparative Example 9

Application amount of CMC; 1.2 dry·g/m$^2$

Aqueous agent component; None (water only)

The other conditions are the same as in Example 1.

Comparative Example 10

Application amount of CMC; 1.2 dry·g/m$^2$

CNF blending ratio; 0.5% by weight

Aqueous agent component; None (water only)

The other conditions are the same as in Example 1.

Comparative Example 11

Application amount of CMC; 1.2 dry·g/$m^2$
CNF blending ratio; 1.0% by weight
Aqueous agent component; None (water only)
The other conditions are the same as in Example 1.

Comparative Example 12

Application amount of CMC; 1.2 dry·g/$m^2$
CNF blending ratio; 2.0% by weight
Aqueous agent component; None (water only)
The other conditions are the same as in Example 1.

Comparative Example 13

Application amount of CMC; 0.0 dry·g/$m^2$
CNF blending ratio; 0.0% by weight
The other conditions are the same as in Example 1.

Comparative Example 14

Sample preparation method; the same as Comparative Example 13
Weighing (in a dry state); 45 g/$m^2$
Application amount of CMC; 0.0 dry·g/$m^2$
CNF blending ratio; 1.0% by weight
The other conditions are the same as in Example 1.

Comparative Example 15

Sample preparation method; the same as Comparative Example 13
Weighing (in a dry state); 45 g/$m^2$
Application amount of CMC; 0.0 dry·g/$m^2$
CNF blending ratio; 2.0% by weight
The other conditions are the same as in Example 1.

[Wet Tensile Strength Test]

The tensile strength [cN/25 mm] in the MD direction is measured for the sample corresponding to each of the Examples and the Comparative Examples prepared using base paper of 300 mm×300 mm. In measuring the tensile strength, the above sample is cut to a width 25 mm×120 mm with a dumbbell cutter according to JIS P 8113, and the conditions of the testing machine is set to be a tensile speed of 500 mm/min and a chuck distance of 50 mm. The tensile strength was measured five times and averaged to obtain each wet tensile strength.

[Evaluation of Water-Disintegrability]

For samples corresponding to Examples 1 to 8 and Comparative Examples 1 to 12, the water-disintegrability is measured according to a method based on JIS P 4501 (2006) 4.5 "easiness of loosening".

Evaluation was set to be "in the case of 80 seconds or less: ◎," "in the case of from 81 to less than 100 seconds: ○," and "in the case of 100 seconds or more: ×".

[Evaluation of Surface Strength]

(Test Method)

The samples of the embossed base paper corresponding to Examples 1 to 8 and Comparative Examples 1 to 12 was each cut off to width 75 mm×length 240 mm without peeling off the ply, folded into three with both end regions in the width direction overlapped, and rubbed with a Gakushin type fastness rubbing tester at the portion to be measured, The number of rubbing was measured at the time when damage such as scuffing or tear was visually confirmed on the paper. At this time, the sample was cut and folded so that a linear portion becomes the portion to be measured.

The test conditions by the Gakushin type fastness rubbing tester were as follows.

Gakushin Type Fastness Rubbing Tester: manufactured by TESTER SANGYO CO., LTD., Item Number AB301

Rubbing Finger:

Shape 20 mm×R 50 mm

Load 200 gf (With white cotton cloth fixed, including arm)

Load Per Unit Area 50 gf/$cm^2$ (Load 200 gf/contact area 4.0 $cm^2$)

As the fixed cotton cloth for the rubbing finger, one piece of PP band (Sekisui Jushi Corporation, Item Number 19K (width 15 mm×length 60 mm)) was fixed to the rubbing finger with screws so that there are no gaps or wrinkles.

Sample Holder:

| | |
|---|---|
| Shape | R200 mm |
| Stroke | 120 mm |
| Reciprocating Frequency | 30 cps |

Sample: Width 25 mm (A sample with a width of 75 mm was folded in three without peeling off the ply)×length 240 mm (Sample holder side)

Test Procedure:

(1) Mount the sample on the sample holder so that it is not loose.

(2) Gently lower the rubbing finger to the sample holder.

(3) Press the start SW to start the test.

Judgment Method: By confirming the state of the sample after Gakushin processing (rubbing), the number of rubbing was measured at the time when damage such as scuffing or tear was visually confirmed on the paper.

In the above test, a PP band with a mesh pattern on the surface is used as the rubbing finger, assuming a case where the toilet cleaning sheet is actually used, that is, a case where the rim of a toilet bowl is rough due to attached stains. As a result, it is possible to conduct an environmental test assuming the actual use of the toilet cleaning sheet and to obtain highly reliable evaluation result on whether or not the toilet cleaning sheet is durable when actually used.

Evaluation result was ◎ if the average value was more than 50 times in both MD direction and CD direction, ○ if it was 40 to 49 times, Δ if it was 30 to 39 times, and x if it was less than 30 times.

[Evaluation of Actual Use]

Samples of embossed base paper corresponding to Examples 5 to 8 and Comparative Example 2 were actually used by 50 users. The users evaluated toughness and satisfaction degree of wiping property (whether or not cleanly wiped) when used in five grades: "Very satisfied: 5 points", "Satisfied: 4 points", "Not bad: 3 points", "Slightly dissatisfied: 2 points," and "Dissatisfied: 1 point." Evaluation on the weighted average was set to be "4.75 or more: ◎", "4.50 or more and less than 4.75: ○", "4.25 or more and less than 4.50: Δ" and "less than 4.25: ×"

The results of respective tests are shown in TABLEs 1 to 5.

TABLE 1 shows the results of wet tensile strength, water-disintegrability, and surface strength for Examples 1 to 4 and Comparative Example 1. TABLE 2 shows the test results of wet tensile strength, water-disintegrability, surface strength, and evaluation of actual use for Examples 5 to 8 and Comparative Example 2.

TABLE 3 shows the test results of wet tensile strength, water-disintegrability, and surface strength for Comparative Examples 3 to 7. TABLE 4 shows the results of wet tensile strength, water decomposability, and surface strength for Comparative Examples 8 to 12.

Further, TABLE 5 shows the test results of the wet tensile strength for Comparative Examples 13 to 15.

TABLE 1

| | Comparative Example 1 | Example 1 | Example 2 | Example 3 | Example 4 |
|---|---|---|---|---|---|
| Application Amount of CMC [dry · g/m$^2$] | 0.6 | 0.6 | 0.6 | 0.6 | 0.6 |
| CNF Blending Ratio [% by weight] | 0.0 | 0.1 | 0.5 | 1.0 | 2.0 |
| Wet Tensile Strength [cN/25 mm] | 513 | 547 | 627 | 647 | 645 |
| Water-Disintegrability | ◎ | ◎ | ◎ | ◎ | ◎ |
| Surface Strength | X | ○ | ○ | ◎ | ◎ |

TABLE 2

| | Comparative Example 2 | Example 5 | Example 6 | Example 7 | Example 8 |
|---|---|---|---|---|---|
| Application Amount of CMC [dry · g/m$^2$] | 1.2 | 1.2 | 1.2 | 1.2 | 1.2 |

TABLE 2-continued

| | Comparative Example 2 | Example 5 | Example 6 | Example 7 | Example 8 |
|---|---|---|---|---|---|
| CNF Blending Ratio [% by weight] | 0.0 | 0.1 | 0.5 | 1.0 | 2.0 |
| Wet Tensile Strength [cN/25 mm] | 641 | 683 | 690 | 706 | 717 |
| Water-Disintegrability | ◎ | ◎ | ◎ | ◎ | ◎ |
| Surface Strength | ◎ | ◎ | ◎ | ◎ | ◎ |
| Evaluation Of Actual Use | | | | | |
| 1) Evaluation of Robustness | ○ | ◎ | ◎ | ◎ | ◎ |
| ① Very satisfied [%] | 82 | 87 | 89 | 90 | 92 |
| ② Satisfied [%] | 12 | 9 | 7 | 8 | 7 |
| ③ Not Bad [%] | 2 | 4 | 4 | 2 | 1 |
| ④ Slightly Dissatisfied [%] | 4 | 0 | 0 | 0 | 0 |
| ⑤ Dissatisfied [%] | 0 | 0 | 0 | 0 | 0 |
| Average | 4.72 | 4.83 | 4.85 | 4.88 | 4.91 |
| 2) Wiping property | ○ | ◎ | ◎ | ◎ | ◎ |
| ① Very satisfied [%] | 78 | 83 | 82 | 83 | 84 |
| ② Satisfied [%] | 14 | 12 | 14 | 14 | 13 |
| ③ Not Bad [%] | 4 | 3 | 3 | 2 | 3 |
| ④ Slightly Dissatisfied [%] | 4 | 2 | 1 | 1 | 0 |
| ⑤ Dissatisfied [%] | 0 | 0 | 0 | 0 | 0 |
| Average | 4.66 | 4.76 | 4.77 | 4.78 | 4.81 |

TABLE 3

| | Comparative Example 3 | Comparative Example 4 | Comparative Example 5 | Comparative Example 6 | Comparative Example 7 |
|---|---|---|---|---|---|
| Application Amount of CMC [dry · g/m$^2$] | 0.6 | 0.6 | 0.6 | 0.6 | 0.6 |
| CNF Blending Ratio [% by weight] | 0.0 | 0.1 | 0.5 | 1.0 | 2.0 |
| Wet Tensile Strength [cN/25 mm] | 83 | 86 | 82 | 84 | 83 |
| Water-Disintegrability | ◎ | ◎ | ◎ | ◎ | ◎ |
| Surface Strength | X | X | X | X | X |

TABLE 4

| | Comparative Example 8 | Comparative Example 9 | Comparative Example 10 | CComparative Example 11 | Comparative Example 12 |
|---|---|---|---|---|---|
| Application Amount of CMC [dry · g/m$^2$] | 1.2 | 1.2 | 1.2 | 1.2 | 1.2 |
| CNF Blending Ratio [% by weight] | 0.0 | 0.1 | 0.5 | 1.0 | 2.0 |
| Wet Tensile Strength [cN/25 mm] | 85 | 84 | 88 | 84 | 86 |
| Water-Disintegrability | ◎ | ◎ | ◎ | ◎ | ◎ |
| Surface Strength | X | X | X | X | X |

TABLE 5

| | Comparative Example 13 | Comparative Example 14 | Comparative Example 15 |
|---|---|---|---|
| Application Amount of CMC [dry · g/m$^2$] | 0.0 | 0.0 | 0.0 |
| CNF Blending Ratio [% by weight] | 0.0 | 1.0 | 2.0 |
| Wet Tensile Strength [cN/25 mm] | 134 | 122 | 140 |

As shown in TABLEs 1 and 2, under the condition that the base paper is impregnated with the aqueous agent to which the cross-linking agent is added, the value of wet tensile strength is larger in the case where CNF was added to the binder solution (Examples 1 to 8) than the case where CNF was not added to the binder solution (Comparative Example 1, Comparative Example 2). Thus, it was confirmed that CNF improves the paper strength of the toilet cleaning sheet (water-disintegrable sheet). As shown in TABLES 1 and 2, the wet tensile strength is improved by setting the addition amount of CNF to 0.1% by weight or more and 2.0% by weight or less with respect to the base paper.

On the other hand, as shown in TABLEs 3 and 4, if the base paper is impregnated with only water without adding the cross-linking agent (Comparative Examples 3 to 12), the wet tensile strength does not improve even if CMC is added and CNF is further added stepwise from 0 to 2.0% by weight. Similarly, as shown in TABLE 5, if the base paper is impregnated with only water without adding the cross-linking agent, the wet tensile strength does not improve even if only CNF is added stepwise from 0 to 2.0% by weight to the base paper without adding CMC.

Regarding the evaluation of water-disintegrability, as shown in TABLEs 1 and 2, it was confirmed that the criterion for water-disintegrability (becoming loose within 100 seconds) was satisfied.

Further, as shown in TABLE 1, under the condition that the base paper is impregnated with the aqueous agent to which the cross-linking agent is added, the surface strength is larger in the case where CNF was added to the binder solution (Examples 1 to 4) than the case where CNF was not added to the binder solution (Comparative Example 1). Further, as shown in TABLE 2, it was found that the surface strength was improved by increasing the application amount of CMC from 0.6 dry·g/m$^2$ to 1.2 dry·g/m$^2$.

Further, as shown in TABLE 2, under the condition that the base paper is impregnated with the aqueous agent to which the cross-linking agent has been added, the evaluation of toughness when used and the evaluation of wiping property by the users improved in the case where CNF was added to the binder solution (Examples 5 to 8) than the case where CNF was not added to the binder solution (Comparative Example 2).

On the other hand, as shown in TABLEs 3 and 4, if the base paper was impregnated with only water without adding the cross-linking agent (Comparative Examples 3 to 12), the surface strength is not improved even if CMC is added and CNF is further added stepwise from 0 to 2.0% by weight.

As described above, according to the present embodiment, it is possible to improve wet tensile strength while maintaining water decomposability by adding CNF to CMC which is the water-soluble binder and impregnating the base paper sheet with the aqueous agent including the cross-linking agent. Therefore, it is possible to suppress the deterioration in operability and productivity due to increase in the application amount of CMC, since the wet tensile strength can be improved without increasing the application amount of CMC included in the binder solution.

That is, although it is generally considered that the wet strength is not improved even if fine cellulose nanofibers are blended in the base paper sheet, according to the present invention, it is possible to further improve the wet strength by further blending cellulose nanofibers in the base paper sheet which is blended with the aqueous agent including the water-soluble binder and the cross-linking agent which cross-links with this water-soluble binder.

Although the present invention has been specifically described based on the embodiments, the present invention is not limited to the above-described embodiments, and modification can be made within a range not departing from the gist thereof.

For example, although a toilet cleaning sheet is described as an example of a water-disintegrable sheet in the embodiments of the present invention, the present invention is not limited thereto, and can be applied to products that are desired to be able to be thrown away after use with a large amount of water in toilet etc., such as a body wiping sheet for wiping the body and a sheet for wiping ass.

In describing the embodiments and the like of the present invention, the emboss EM11 with a protrusion PR21 having a curved shape and the emboss EM12 with a protrusion PR22 having a planar shape are shown as an example, but the emboss is not necessarily limited to these shapes, but may have any shape.

For example, in describing the embodiments and the like of the present invention, all of the embosses EM11 and EM12 project toward the front side of the drawing in FIG. 1. However, the embosses EM11 and EM12 projecting toward the front direction of the drawing and the embosses EM11 and EM12 recessed toward the front direction of the drawing may be arranged alternately.

Figure 9:
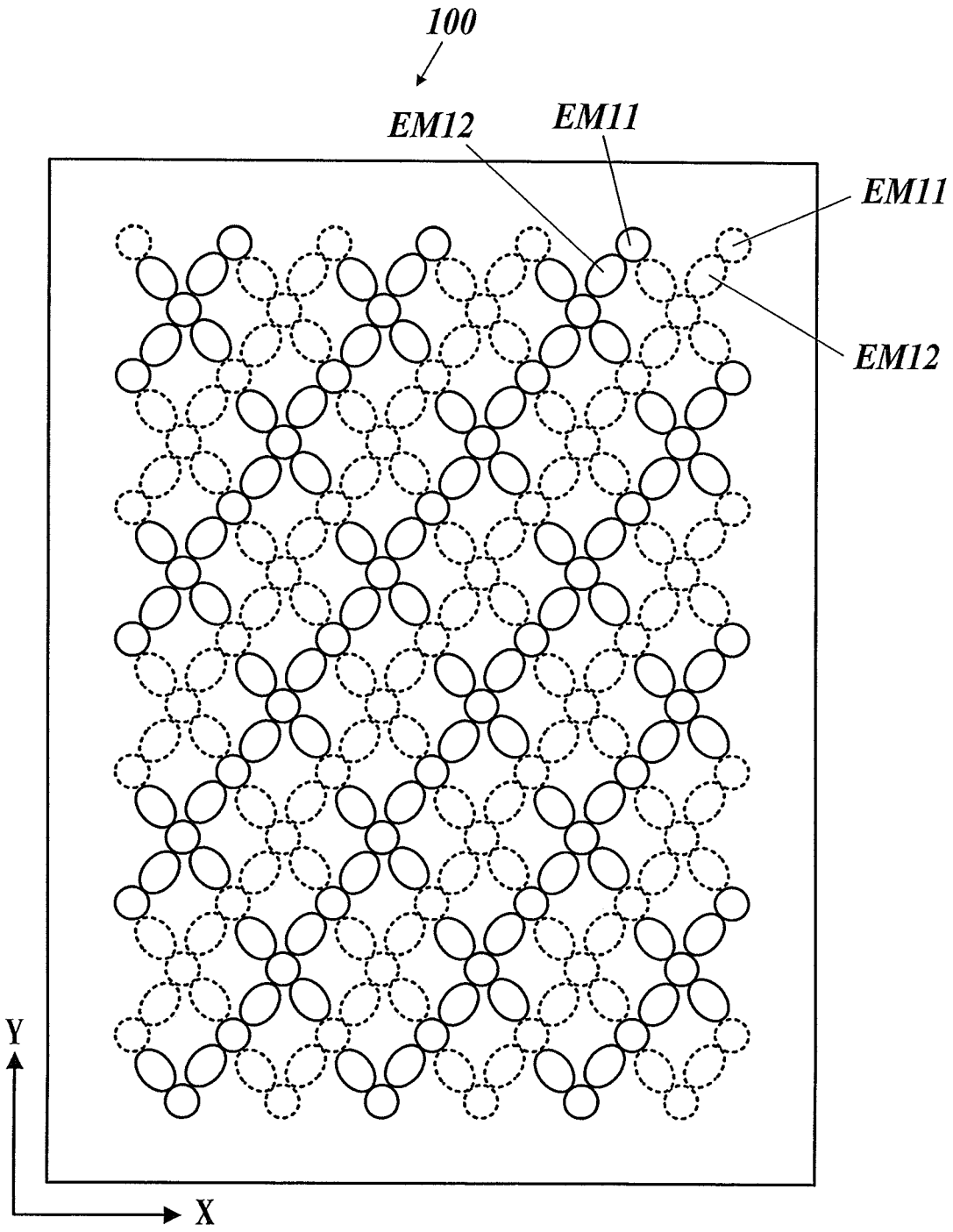
FIG. 9 is a plan view showing another example of the toilet cleaning sheet according to the present embodiment.

Specifically, as shown in FIG. 9, by alternately arranging the embosses EM11 and EM12 projecting toward the front direction of the drawing in FIG. 9 (solid line portions) and the embosses EM11 and EM12 recessed toward the front direction of the drawing in FIG. 9 (broken line portions), it is possible to improve the surface strength of the water-disintegrable sheet and to provide a water-disintegrable sheet with high wiping property on either side of the toilet cleaning sheet 100 by the embosses.

Figure 10:
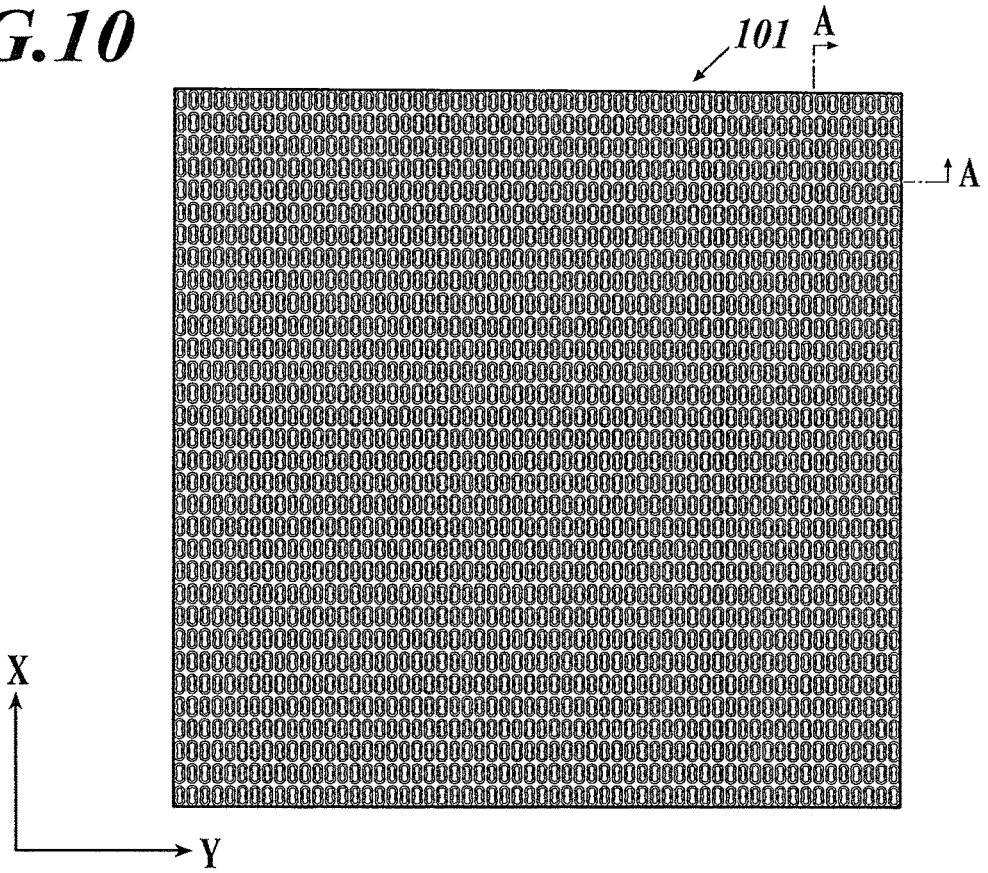
FIG. 10 is a plan view showing another example of the toilet cleaning sheet according to the present embodiment.
Figure 11:
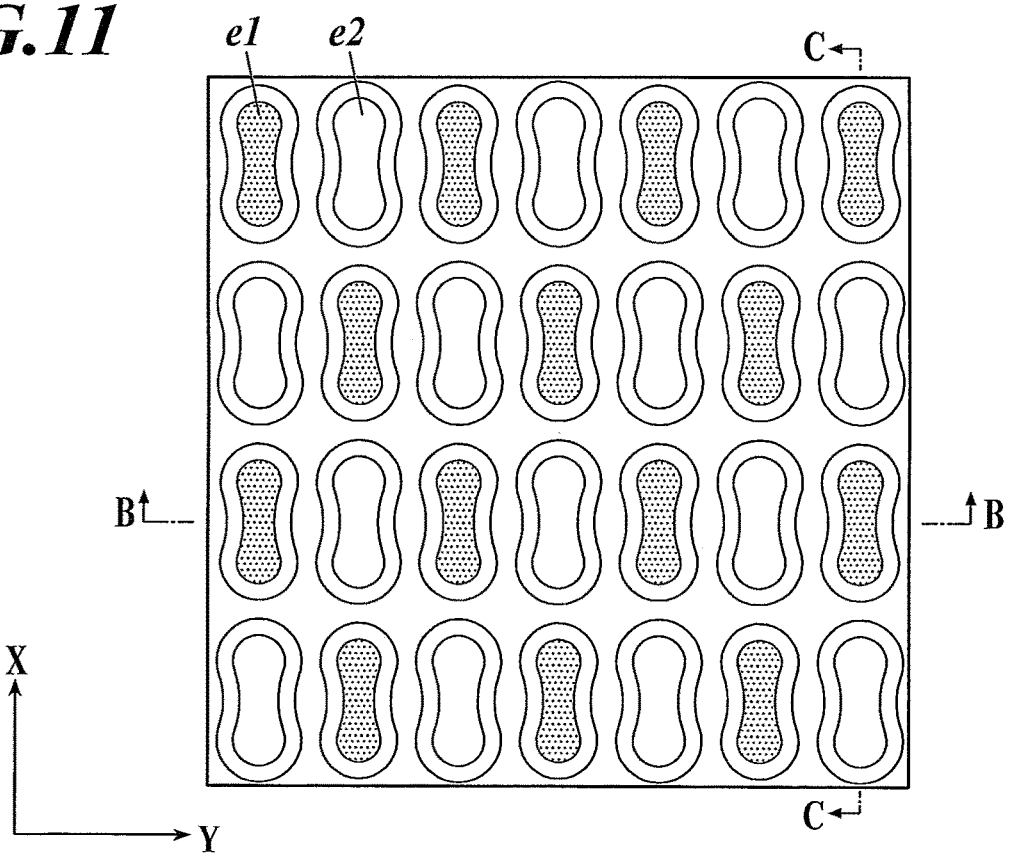
FIG. 11 is an enlarged view of a portion A-A of FIG. 10.
Figure 12A:
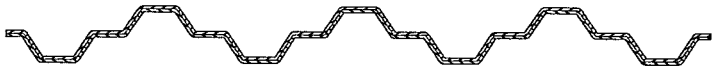
FIG. 12A is an end view of the cut-off portion taken along line B-B of FIG. 11.
Figure 12B:
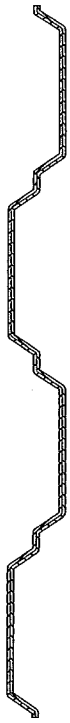
FIG. 12B is an end view of the cut-off portion taken along line C-C of FIG. 11.

FIGS. 10 to 12 show a modified example in which only the emboss pattern of the toilet cleaning sheet is different.

In FIGS. 10 to 12, the concave portion e2 has an inverted shape of the convex portion e1. The convex portion e1 and the concave portion e2 are alternately arranged in each of multiple rows. An emboss pattern is formed by arranging the multiple rows such that the convex portions e1 in adjacent rows are shifted from each other by a half pitch, and so are the concave portions e2. In this way, since the convex portions e1 and the concave portions e2 are alternately formed both in the length direction and the width direction, it is possible to improve the property of wiping stain compared with the emboss pattern in which the convex portions are arranged in a row or the concave portions are arranged in a row. The shapes of the convex portions e1 and the concave portions e2 are not particularly limited, and may be a circular shape, an elliptical shape, a polygonal shape, or the like. It may be a combination of the shapes.

In describing the embodiments and the like of the present invention, the binder solution to which CNF is added is applied with a spray, however, the binder solution may be applied to the continuous dry base paper 1A continuously drawn out from the first web roll 1 by a doctor chamber system (transfer equipment including two paired printing plate rolls with respect to one backup roll, anilox rolls paired with the respective printing plate rolls, and doctor chambers for applying the binder solution to the respective anilox rolls), and/or a three roll system (transfer equipment including two paired printing plate rolls with respect to one backup roll, anilox rolls paired with the respective printing plate rolls, dip rolls for applying the binder solution to the respective anilox rolls, and pans for applying the binder solution to the respective dip rolls). That is, a method of producing a water-disintegrable sheet in which multiple sheets of the base paper (continuous dry base paper 1A) to which the ply process has been applied includes; the solution adding step of applying (transferring) the binder solution to at least one of the surfaces of the base paper serving as front and back surfaces of the water-disintegrable sheet among the multiple sheets of the base paper without including the water-soluble binder; the ply processing step of applying the ply process to multiple sheets of the base paper; the drying step of drying the sheet after the ply process; and a winding step of forming slits in the sheet dried in the drying step at a predetermined width and winding the sheet. In the solution adding step, from a printing machine(s) provided corresponding to at least one of the surfaces of the base paper serving as the front and back surfaces of the water-disintegrable sheet, the binder solution is transferred to the corresponding base paper.

In the solution adding step, as well as applying the binder solution to at least one of the surfaces of the base paper serving as the front and back surfaces of the water-disintegrable sheet among the multiple sheets of base paper without including the water-soluble binder, the binder solution may be applied to at least one of the surfaces of the base paper serving as the front and back surfaces of the water-disintegrable sheet among the multiple sheets of base paper including the water-soluble binder.

In a simple roll transfer, the binder solution of an extremely high concentration is required in order to apply a desired amount of the binder solution. Such a binder solution has high viscosity and cannot be uniformly transferred by the roll transfer. If the concentration is lowered in order to lower the viscosity, it is impossible to apply a desired amount as described above. Since it is extremely difficult to apply the binder solution to the dry base paper in this way, a doctor chamber system or/and a three roll system are adopted.

By adopting a doctor chamber system or/and a three roll system in which paired printing plate rolls are provided with respect to one backup roll, even if the application amount with each printing plate roll is small, a sufficient amount of the binder solution can be applied to the dried base paper in a total amount. Further, since there is only one backup roll, extremely uniform application can be made. Since the tension between a first printing plate roll and the next printing plate roll is extremely stable and constant due to the single backup roll, it is possible to apply the binder solution extremely uniformly to the continuous base paper even by application in two steps using two printing plate rolls. Further, since the distance between the two printing plate rolls is short, immediately after application of the binder solution with the first printing plate roll, application can be made with the next printing plate roll. This also results in uniform transfer without uneven application. Such an effect cannot be obtained merely by providing the backup roll and the printing plate roll paired in two steps.

Further, it is preferable to apply the binder solution by the doctor chamber system because the binder solution can be more uniformly and stably transferred in the width direction the doctor chamber system than in the three-roll system.

Further, in the drying step, the continuous paper to which the binder solution is applied is dried. This drying step preferably includes indirect drying without direct contact to the continuous paper, particularly preferably by infrared ray irradiation. In the case of indirect drying, the occurrence of wrinkles is suppressed. In particular, since various parts of the paper surface is dried uniformly in the case of infrared ray irradiation, it is possible to effectively prevent the occurrence of wrinkles and distortion during drying.

Hereinafter, the doctor chamber system will be described in detail as an example.

In the transfer equipment for this doctor chamber system, one printing plate roll is provided for one backup roll.

The application of the binder solution is operated at an application processing speed of 30 to 100 m/min, more preferably at 50 to 80 m/min. If it is less than 30 m/min, the crepe will elongate before being dried and results in a problem of difficult processing the following steps. On the contrary, if it is more than 100 m/min, a sufficient transfer amount cannot be obtained, or uneven wet strength and uneven water-disintegration occurs due to uneven application amount in the width direction.

The diameter of the backup roll is suitably from 250 to 420 mm. If the diameter is less than 250 mm, stable application cannot be performed since the contact area between the printing plate roll and the backup roll becomes small. If the diameter is more than 420 mm, there is no problem in terms of production, but it is not preferable because the equipment cost is excessive.

For the above printing plate rolls, anilox rolls which deliver the binder solution to the respective printing plate rolls are provided. For these anilox rolls, doctor chambers which deliver and apply the binder solution to the anilox rolls are provided. Further, for the doctor chambers, snake pumps which deliver and apply the binder solution to the doctor chambers are installed at both a feeding part and a returning part for supplying to the solution pan of the anilox roll, so that the binder solution with high viscosity can be delivered to the doctor chamber.

The continuous dry base paper 1A drawn out from the primary web roll 1 is wound around a backup roll through an appropriate guide roll so as to have appropriate tension and surface stability.

Then, with the printing plate roll, the binder solution is roll-transferred onto the continuous dry base paper 1A wound around the backup roll.

Here, the printing plate roll is a seamless roll for solid printing without concave grooves, and the binder solution is applied to the entire continuous dry base paper 1A as a solid printing. The seamless roll used as this printing plate roll is obtained by winding a rubber plate around a sleeve of a type roll, overheating and welding it in a pot, and polishing it. Depending on the intended purposes, it is possible to select the quality, hardness, color, etc. of the rubber plate used as the material.

On the other hand, depending on the concentration of the binder solution, it is desirable that the number of lines and the cell capacity of the anilox roll delivering the binder solution to the printing plate roll are respectively 60 to 120 lines/inch and 40 to 90 ml/m$^2$. If the number of lines is less than 60 lines/inch, excessive binder solution is delivered to the printing plate roll, and as a result, the binder solution is likely to be unevenly applied from the printing plate roll to the continuous dry base paper 1A. On the other hand, if the number of lines exceeds 120 lines/inch, it is difficult to deliver the binder solution to the entire circumferential surface of the printing plate roll in a sufficient amount. If the cell capacity is less than 40 ml/m$^2$, it is difficult to deliver the binder solution to the printing plate roll in a sufficient amount. The cell capacity of more than 90 ml/m$^2$ merely results in yield degradation.

Only the continuous dry base paper 1A which serves as an uppermost layer or a lowermost layer after the ply process is subjected to the binder solution application (transfer) as described above. That is, for example, in the case of three-ply process, the binder solution is not applied (transferred) to the continuous dry base paper 1A which serves as a middle layer.

The binder solution is transferred to the continuous dry base paper 1A in the above-described doctor chamber system, that is, the binder solution is transferred to the continuous dry base paper 1A before the ply processing step. However, the binder solution may be transferred to the ply continuous sheet 1B to which the ply process has been applied in the ply processing step.

That is, a method of producing a water-disintegrable sheet in which the ply process has been applied to the multiple sheets of the base paper (continuous dry base paper 1A) includes; the ply processing step of applying the ply process to multiple sheets of the base paper without including the water-soluble binder; the solution adding step of applying (transferring) the binder solution to the sheet after the ply process; a drying step of drying the sheet to which the binder solution is applied; and the winding step of forming slits in the sheet dried in the drying step at a predetermined width and winding the sheet. In the solution adding step, from the printing machine provided corresponding to at least one of the outer surfaces of the sheet after the ply process, the binder solution is transferred to the corresponding outer surface.

In the ply processing step, in addition to applying the ply process to the multiple sheets of base paper without including the water-soluble binder, the ply process may be applied to multiple sheets of base paper including the water-soluble binder.

In this way, in the case of transferring the binder solution by the doctor chamber system, since it is possible to apply the binder solution having high viscosity, infiltration of the binder solution to inside of the sheet can be suppressed. Therefore, it is possible to fix CMC and CNF only at the sheet surface. As well as being transferred by the doctor chamber system, for example, the binder solution may be coated on the sheet surface with a coater for hot melt resin coating. In such a case, it is also possible to fix CMC and CNF only at the sheet surface.

Further, in the papermaking step, the water-soluble binder and CNF may be internally added, that is, a predetermined amount thereof may be each blended into the pulp fibers as the papermaking raw material. In this case, the water-soluble binder and CNF are uniformly blended in the base paper. Further, at least one of the water-soluble binder and CNF may be added by combining internal addition and an external addition.

Further, the water-soluble binder and CNF may be added at different timings. Specifically, the water-soluble binder may be internally added and CNF may be externally added, or vice versa. Furthermore, if both are internally added or both are externally added, they may be added at different timings.

INDUSTRIAL APPLICABILITY

The present invention is suitable for providing a water-disintegrable sheet such as a toilet cleaning sheet which is impregnated with an aqueous agent in advance, and a method for producing the water-disintegrable sheet.

REFERENCE SIGNS LIST

100, 101 Toilet Cleaning Sheet
1 Primary Web Roll
1A Continuous Dry Base Paper
1B Ply Continuous Sheet
1C Continuous Sheet
1D Continuous Water-Disintegrable Sheet
1E Embossed Sheet
2 Overlapping Unit
3 Spray Nozzle
4 First Drying Equipment
5 Slitter
6 Winder Equipment
11 Secondary Web Roll
12 Embossing Roll
13 Finishing Processing Equipment
14 Former
15 Wire
16 Suction Box
17 first Dry Part
18 Rotating Drum
19 Hood
20 Upper Conveyor Belt
21 Lower Conveyor Belt
22 Vacuum Roll
23 Spray Nozzle
24 Second Dry Part
25 Rotating Drum
26 Hood
EM11 Emboss
EM12 Emboss
PR21 Protrusion
PR22 Protrusion
HT21 Height Of Protrusion
HT22 Height Of Protrusion
CN31 Contact Area
SN32 Contact Area
e1 Convex Portion
e1 Concave Portion

The invention claimed is:

1. A water-disintegrable sheet comprising a base paper fiber sheet, wherein the base paper sheet has a weight per unit area of 30 to 150 gsm, contains a water-soluble binder and cellulose nanofibers, is impregnated with an aqueous agent that includes a cross-linking agent which cross-links with the water-soluble binder, and a fiber orientation ratio of a length direction of the base paper sheet to a width direction of the base paper sheet is between 0.8 to 1.2, wherein the length direction is a conveyance direction at the time of producing the base paper sheet of a papermaking machine.

2. The water-disintegrable sheet according to claim 1, wherein: the water-soluble binder has a carboxyl group, and the cross-linking agent is a metal ion.

3. The water-disintegrable sheet according to claim 2, wherein a content of the water-soluble binder gradually increases from an inner side toward a front surface and toward a back surface in a thickness direction of the base paper sheet.

4. The water-disintegrable sheet according to claim 1, wherein a content of the water-soluble binder gradually increases from an inner side toward a front surface and toward a back surface in a thickness direction of the base paper sheet.

5. The water-disintegrable sheet according to claim 1, wherein: the water-soluble binder is carboxymethyl cellulose (CMC), and the cross-linking agent is selected from the group consisting of alkaline earth metals, manganese, zinc, cobalt, and nickel.

6. The water-disintegrable sheet according to claim 1, wherein the water soluble binder and the cellulose nanofibers are applied to at least one outer surface of the base paper sheet as a binder solution containing the water-soluble binder and the cellulose nanofibers.

7. The water-disintegrable sheet according to claim 1, wherein the water soluble binder and the cellulose nanofibers are applied to two outer surfaces of the base paper sheet as a binder solution containing the water-soluble binder and the cellulose nanofibers.

8. The water-disintegrable sheet according to claim 1, wherein: the base paper sheet comprises a plurality of first embossed portions having a first shape and a plurality of second embossed portions having a second shape, the first shape being different from the second shape, the plurality of first embossed portions are arranged in a diamond lattice shape, and each of the plurality of second embossed portions is positioned between two of the first embossed portions.

9. The water-disintegrable sheet according to claim 8, wherein the first embossed portions are first protrusions, and the second embossed portions are second protrusions, and the first and second protrusions protrude in a same direction from a surface of the base paper sheet.

10. The water-disintegrable sheet according to claim 9, wherein each of the second protrusions is continuous with two first protrusions adjacent thereto, to form a continuous embossed portion including both the first and second embossed portions.

11. The water-disintegrable sheet according to claim 8, wherein: the plurality of first embossed portions comprise a plurality of concave portions and a plurality of convex portions, all having the first shape, and the plurality of second embossed portions comprise a plurality of concave portions and a plurality of convex portions, all having the second shape.

12. A method for producing a water-disintegrable fiber sheet, the method comprising:

applying a binder solution comprising a water-soluble binder and cellulose nanofibers to at least one outer surface of a base paper sheet; and impregnating the base paper sheet with an aqueous agent including a crosslinking agent which cross-links with the water-soluble binder, wherein the base paper sheet has a weight per unit area of 30 to 150 gsm, and a fiber orientation ratio of a length direction of the base paper sheet to a width direction of the base paper sheet is between 0.8 to 1.2, wherein the length direction is a conveyance direction at the time of producing the base paper sheet of a papermaking machine.

13. The method according to claim 12, wherein the binder solution is applied to the at least one outer surface of the base paper sheet so that an addition amount of the cellulose nanofibers is at least 0.1% by weight and at most 2.0% by weight with respect to the base paper sheet.

14. The method according to claim 12, wherein the binder solution is applied to both surfaces of the base paper sheet.

15. The method according to claim 12, wherein the binder solution is applied to the base paper sheet while the base paper sheet is dry.

16. The method according to claim 15, further comprising drying the base paper sheet after the binder solution is applied and before the base paper sheet is impregnated with the aqueous agent.

17. The method according to claim 12, wherein applying the binder solution further comprises:

spraying the binder solution onto the at least one outer surface of the base paper sheet.

18. The method according to claim 17, wherein the binder solution is sprayed onto the base paper sheet while the base paper sheet is dry.

19. The method according to claim 17, wherein the binder solution is sprayed onto both surfaces of the base paper sheet.

20. The method according to claim 12, wherein: the water-soluble binder has a carboxyl group, and the cross-linking agent is a metal ion.

21. The method according to claim 12, wherein: the water-soluble binder is carboxymethyl cellulose (CMC), and the cross-linking agent is selected from the group consisting of alkaline earth metals, manganese, zinc, cobalt, and nickel.

* * * * *